US010077571B2

(12) United States Patent
Hsu et al.

(10) Patent No.: US 10,077,571 B2
(45) Date of Patent: Sep. 18, 2018

(54) ILLUMINATED WATER SPRAYER

(71) Applicant: INTEX RECREATION CORP., Long Beach, CA (US)

(72) Inventors: Yaw Yuan Hsu, Fujian (CN); Hua Hsiang Lin, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 15/500,854

(22) PCT Filed: Apr. 8, 2016

(86) PCT No.: PCT/US2016/026677
§ 371 (c)(1),
(2) Date: Jan. 31, 2017

(87) PCT Pub. No.: WO2016/164747
PCT Pub. Date: Oct. 13, 2016

(65) Prior Publication Data

US 2017/0218648 A1 Aug. 3, 2017

(30) Foreign Application Priority Data

Apr. 8, 2015 (CN) ..... 2015 2 02058702
Apr. 8, 2015 (CN) ..... 2015 2 02071054
(Continued)

(51) Int. Cl.
*F21S 8/00* (2006.01)
*E04H 4/14* (2006.01)
(Continued)

(52) U.S. Cl.
CPC ..... *E04H 4/148* (2013.01); *B05B 1/04* (2013.01); *B05B 1/1636* (2013.01);
(Continued)

(58) Field of Classification Search
CPC ..... E04H 4/148; B05B 1/04; B05B 1/1636; B05B 15/061; B05B 17/085; F21S 9/046
(Continued)

(56) References Cited

U.S. PATENT DOCUMENTS 3,503,554 A 3/1970 Clifton
3,845,291 A 10/1974 Portyrata
(Continued)

FOREIGN PATENT DOCUMENTS

CN 201586580 9/2010
WO 20090104020 8/2009

OTHER PUBLICATIONS

Fountain People, Inc., "The Fountain Catalog," Copyright 2004, available online at http://fountainpeople.com/files/fp_catalog_sweb.pdf, 116 pages.

(Continued)

*Primary Examiner* — Steven J Ganey
(74) *Attorney, Agent, or Firm* — Faegre Baker Daniels LLP

(57) ABSTRACT

The present disclosure relates to a water sprayer and various features thereof. More particularly, the present disclosure relates to a water sprayer for use in a pool, and to a method for using the same. In various embodiments, the water sprayer may include a water output mechanism and a light source that is powered by flowing water to provide illumination functionality.

30 Claims, 23 Drawing Sheets

(30) Foreign Application Priority Data

May 14, 2015 (CN) ..... 2015 2 03107091
Aug. 17, 2015 (CN) ..... 2015 2 06185393
Aug. 17, 2015 (CN) ..... 2015 2 06185887

(51) Int. Cl.

| | |
|---|---|
| ***B05B 15/06*** | (2006.01) |
| ***B05B 1/04*** | (2006.01) |
| ***B05B 17/08*** | (2006.01) |
| ***B05B 1/16*** | (2006.01) |
| ***F21S 9/04*** | (2006.01) |
| ***B05B 15/62*** | (2018.01) |
| *F21W 121/02* | (2006.01) |
| *F21W 131/401* | (2006.01) |

(52) U.S. Cl.
CPC ..... *B05B 15/061* (2013.01); *B05B 15/62* (2018.02); *B05B 17/085* (2013.01); *F21S 9/046* (2013.01); *F21W 2121/02* (2013.01); *F21W 2131/401* (2013.01)

(58) Field of Classification Search
USPC ..... 239/12, 18–20, 380–383, 592–595, 239/597–599; 362/96, 562; 4/492
See application file for complete search history.

(56) References Cited

U.S. PATENT DOCUMENTS

| | | | | |
|---|---|---|---|---|
| 4,749,126 | A | 6/1988 | Kessener | |
| 4,823,409 | A | 4/1989 | Gaffney | |
| 4,920,465 | A * | 4/1990 | Sargent | F21S 9/046 239/18 |
| 5,207,499 | A * | 5/1993 | Vajda | A61H 33/6063 239/18 |
| 7,413,319 | B2 | 8/2008 | Longoria et al. | |
| 7,607,789 | B2 * | 10/2009 | Lu | F21V 33/004 239/18 |
| 7,717,582 | B2 | 5/2010 | Longoria et al. | |
| 8,214,935 | B2 * | 7/2012 | Colin | B05B 1/3073 239/17 |
| 2002/0154516 | A1 | 10/2002 | Dongo | |
| 2006/0021127 | A1 | 2/2006 | Li et al. | |
| 2006/0042689 | A1 | 3/2006 | Hinojosa, Jr. | |
| 2006/0117476 | A1 | 6/2006 | Kunkel | |
| 2011/0290901 | A1 | 12/2011 | Dittman | |

OTHER PUBLICATIONS

International Search Report and Written Opinion dated Jul. 5, 2016 in International Application No. PCT/US2016/026677, 9 pages.
Extended European Search Report for PCT/US2016/026677, dated Sep. 11, 2017, 7 pgs.

* cited by examiner

ILLUMINATED WATER SPRAYER

CROSS REFERENCE TO RELATED APPLICATIONS

This application is a national stage filing of PCT International Application Serial No. PCT/US2016/026677, filed Apr. 8, 2016, the disclosure of which is hereby expressly incorporated by reference herein in its entirety. This application also claims priority to the following applications, the disclosures of which are hereby expressly incorporated by reference herein in their entirety:

| Application No. | Filing Date |
|---|---|
| CN 2015202058702 | Apr. 8, 2015 |
| CN 2015202071054 | Apr. 8, 2015 |
| CN 2015203107091 | May 14, 2015 |
| CN 2015206185393 | Aug. 17, 2015 |
| CN 2015206185887 | Aug. 17, 2015 |

FIELD OF THE DISCLOSURE

The present disclosure relates to a water sprayer and various features thereof. More particularly, the present disclosure relates to a water sprayer for use in a pool, and to a method for using the same.

BACKGROUND OF THE DISCLOSURE

There are many ways to enhance pool recreation. One such way is the use of a water spraying mechanism or a water sprayer. Water sprayers can include various structures and offer various forms of functionality. Existing water sprayers, however, are simple in both structure and function.

For example, water sprayers can include a light source (e.g., LED) to offer an LED illumination function. Existing water sprayers have an LED illumination function powered by batteries. But such a mechanism is inconvenient, as it requires regularly replacing batteries. Other existing water sprayers offering an LED illumination function are driven by water flow generator mechanisms that supply power to the LED, where water flow rotates a rotor to produce a current and a corresponding voltage. The voltage and current supplied by these water flow generator mechanisms, however, are dependent on water pressure and water flow rate. Thus, when the water pressure and water flow rate generate voltage and current higher than the rated voltage and rated current of the LED, the LED may burn out. Correspondingly, where the water pressure and water flow rate are low, the water flow generator mechanism produces current insufficient to meet the need of the lighting device, thus shortening the useful life of the LED.

Water sprayers can also be structured to produce a water sheet output (i.e., a water sheet sprayer). To form a water sheet output, water sheet sprayers generally have an outlet structure with an elongated opening. However, due to traditional piping structures and water viscosity properties, existing water sheet sprayers suffer from uneven and irregular water flow at the output, which affects the appearance and comfort of the water sheet. Oftentimes, instead of a water sheet output, the result is a water output in the shape of a flat ellipse. These disadvantages are heightened in situations in which the size of the outlet structure is significantly larger than the size of the inlet structure.

In view of these disadvantages, it would be beneficial to have a water sprayer with illumination functionality independent of water pressure and water flow rate. Furthermore, it would also be beneficial to have a water sheet sprayer with improved and consistent water flow.

SUMMARY

The present disclosure provides a water sprayer, various water sprayer features, and further relates to methods for using the same. Various configurations of the water sprayer are contemplated as within the scope of the present disclosure. Each water sprayer may include a water output mechanism and a light source that is powered by flowing water to illuminate the sprayed water.

According to one embodiment of the present disclosure, a water sprayer comprises a spraying cover further comprising a sealing element, wherein the sealing element is disposed in the spraying cover, and an adjusting valve, wherein the adjusting valve is rotatably accommodated in the spraying cover and cooperated with the sealing element to close the outlet of the spraying cover, and is disposed with a water spout passage and a water curtain passage, and is further disposed with a handle, wherein when the adjusting valve is rotated, the sealing element closes the water spout passage or the water curtain passage, or the sealing element opens the water spout passage and the water curtain passage at the same time.

According to another embodiment of the present disclosure, a water sprayer comprises an outlet component disposed at an outlet end of an outlet waterway, a decompression waterway connected to the outlet waterway, an elastic element, and a valve spool to open and close the decompression waterway, wherein the elastic element applies elastic force on the valve spool to make the valve spool close the decompression waterway, and when the pressure valve of the waterway to the valve spool is larger than the elastic force of the elastic element to the valve spool, the valve spool is pushed away, and the decompression waterway is open.

According to a further embodiment of the present disclosure, a water sprayer comprises a main body, a cover plate, a water pipe, and a rectifying chamber, wherein a front end of the main body cooperates with the cover plate and forms an elongated outlet extending in the horizontal direction, a rear end of the main body is disposed with an inlet connected to the water pipe, the main body is assembled to the cover plate to define a hollow chamber connecting the inlet and the outlet, the rectifying chamber is assembled to the end of the hollow chamber and is connected to the outlet, the rectifying chamber has wavy sub-hollow chamber.

According to another embodiment of the present disclosure, a water sprayer end comprises an outlet nozzle, wherein the outlet nozzle is bilaterally symmetrical and the width of the outlet nozzle is gradually larger from the center to both outer ends, the outlet nozzle has a closed elongated hole comprising a lateral straight line section, a curve line section, a left connecting line section, and a right connecting line section when projected or expanded in the horizontal plane, and wherein water sprays out of the outlet nozzle to form a water sheet of even thickness.

According to a further embodiment of the present disclosure, an impeller speed-up mechanism comprises a deflecting cover, and an impeller, wherein the deflecting cover is disposed with an inlet passage running through the deflecting cover vertically, the impeller is rotatably disposed in the inlet passage, the outer periphery surface of the impeller is disposed with a plurality of blades evenly arranged in the periphery and inclined to the left with respect to the axis of the inlet passage, wherein a plurality of drain plates are evenly disposed at the side wall of the inlet passage in the circumferential direction, the drain plates incline to the right with respect to the axis of the inlet passage.

According to yet another embodiment of the present disclosure, a water sprayer outlet mechanism is disclosed for use with a pool. The water sprayer outlet mechanism has an inlet and an outlet nozzle in fluid communication with the inlet, the outlet nozzle including an elongate hole configured to deliver water from the inlet to the pool, a planar projection of the elongate hole having a lateral axis and a central axis of symmetry, the elongate hole defined by a first elongate section, a second elongate section, a first end section that connects the first and second elongate sections, and a second end section that connects the first and second elongate sections, wherein a width of the elongate hole measured between the first and second elongate sections increases from the central axis to each of the first and second end sections.

According to yet another embodiment of the present disclosure, a water sprayer outlet mechanism is disclosed for use with a pool. The water sprayer outlet mechanism includes a water passageway with an inlet and an elongate outlet that widens laterally, a power generating mechanism positioned along the water passageway, and a light source powered by the power generating mechanism and configured to illuminate water in the water passageway.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
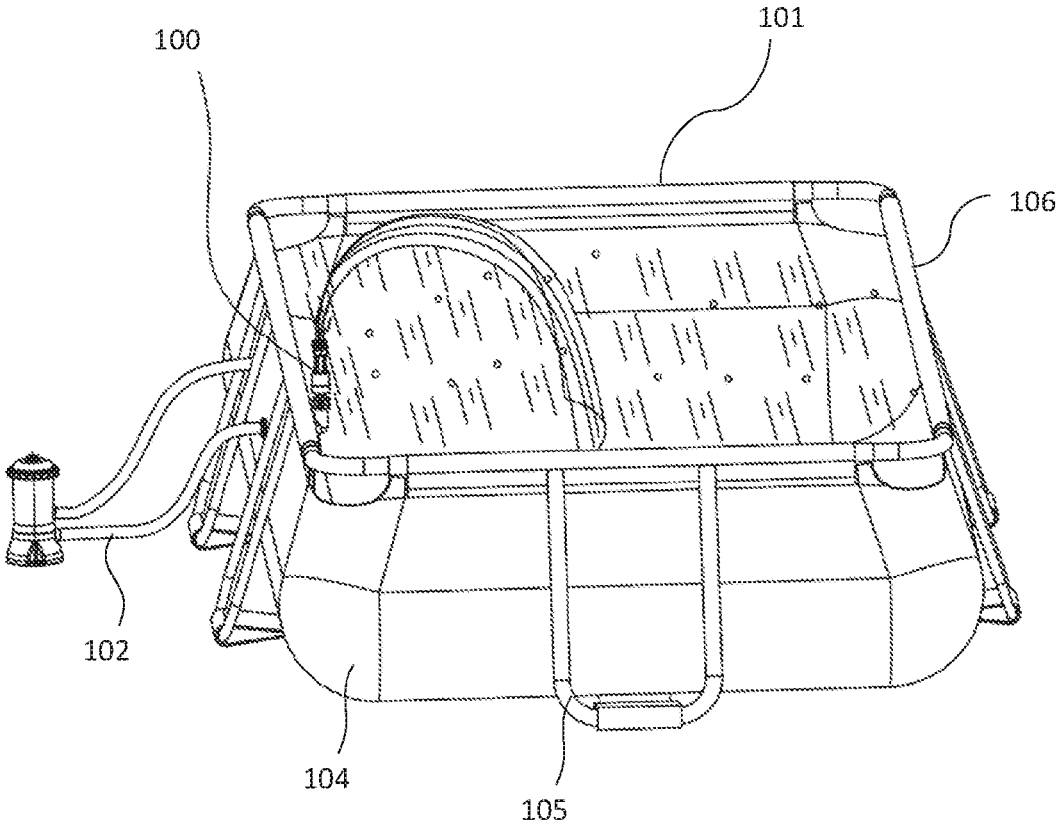
FIG. 1 is a perspective view of a pool with an exemplary L-shaped water sprayer.

FIGS. 1-6 provide an exemplary embodiment of a water sprayer outlet mechanism 100. Among other uses, water sprayer outlet mechanism 100 may be used to spray water into an above ground pool 101, as shown in FIG. 1, or another suitable pool of water, such as an inflatable pool or a heated spa. The illustrative pool 101 includes a wall or liner 104, a plurality of vertical support structures or legs 105, and an upper annular support structure 106. The water sprayer outlet mechanism 100 may be partially or entirely concealed inside an outer cover (e.g., box) to provide a clean and modern appearance.

Figure 2:
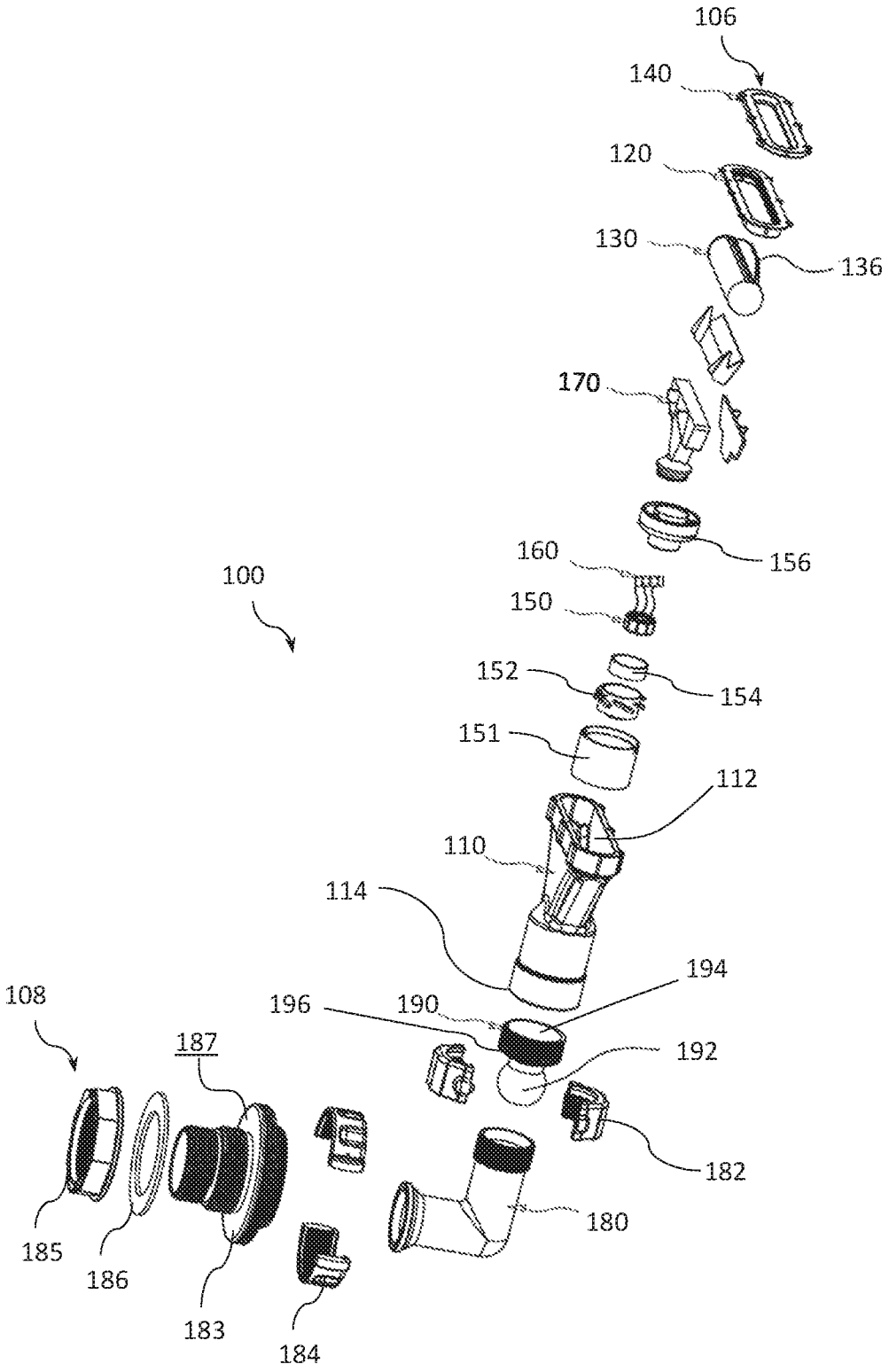
FIG. 2 is an exploded perspective view of the L-shaped water sprayer of FIG. 1.
Figure 3:
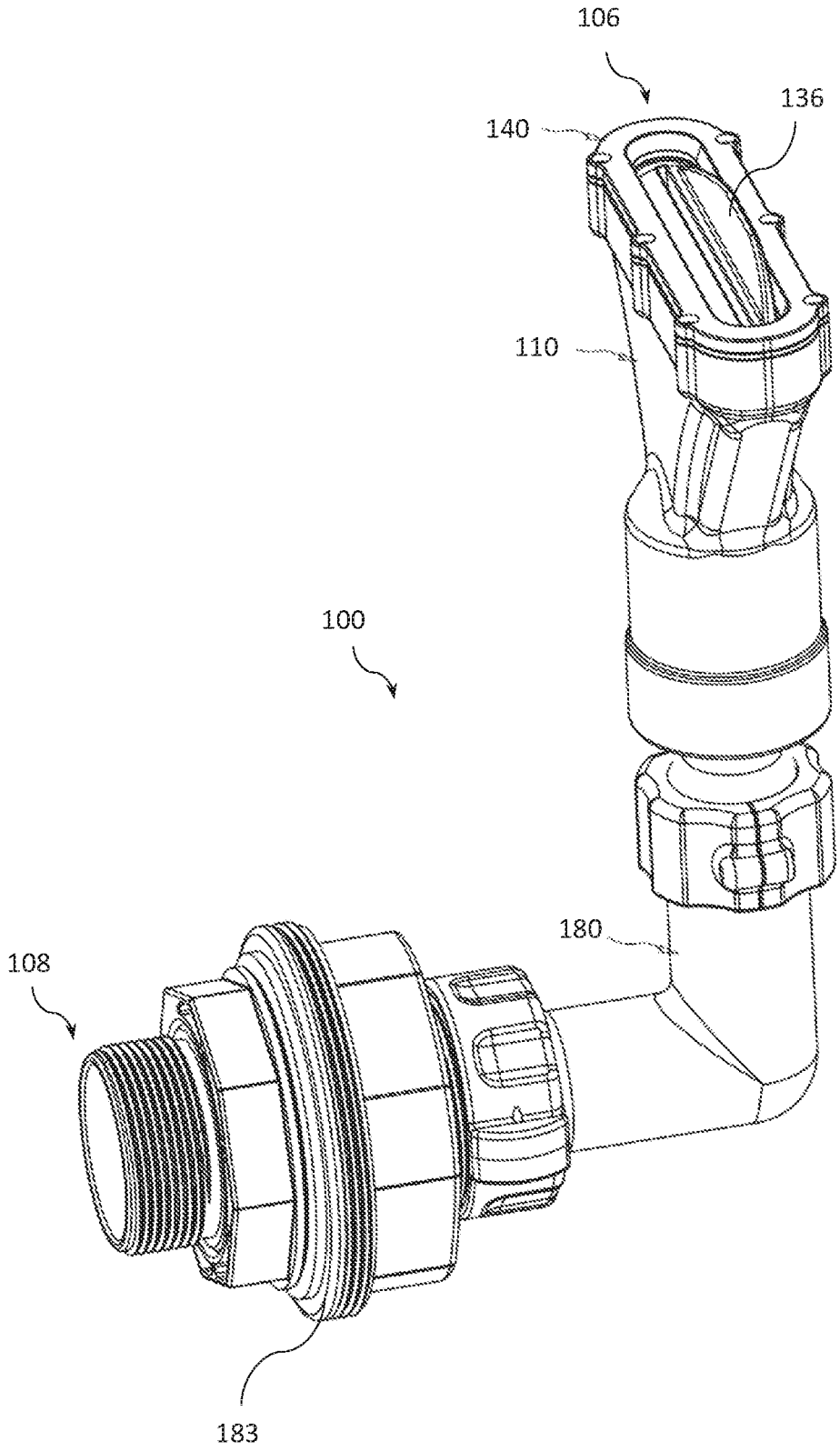
FIG. 3 is an assembled perspective view of the L-shaped water sprayer of FIG. 2.
Figure 4:
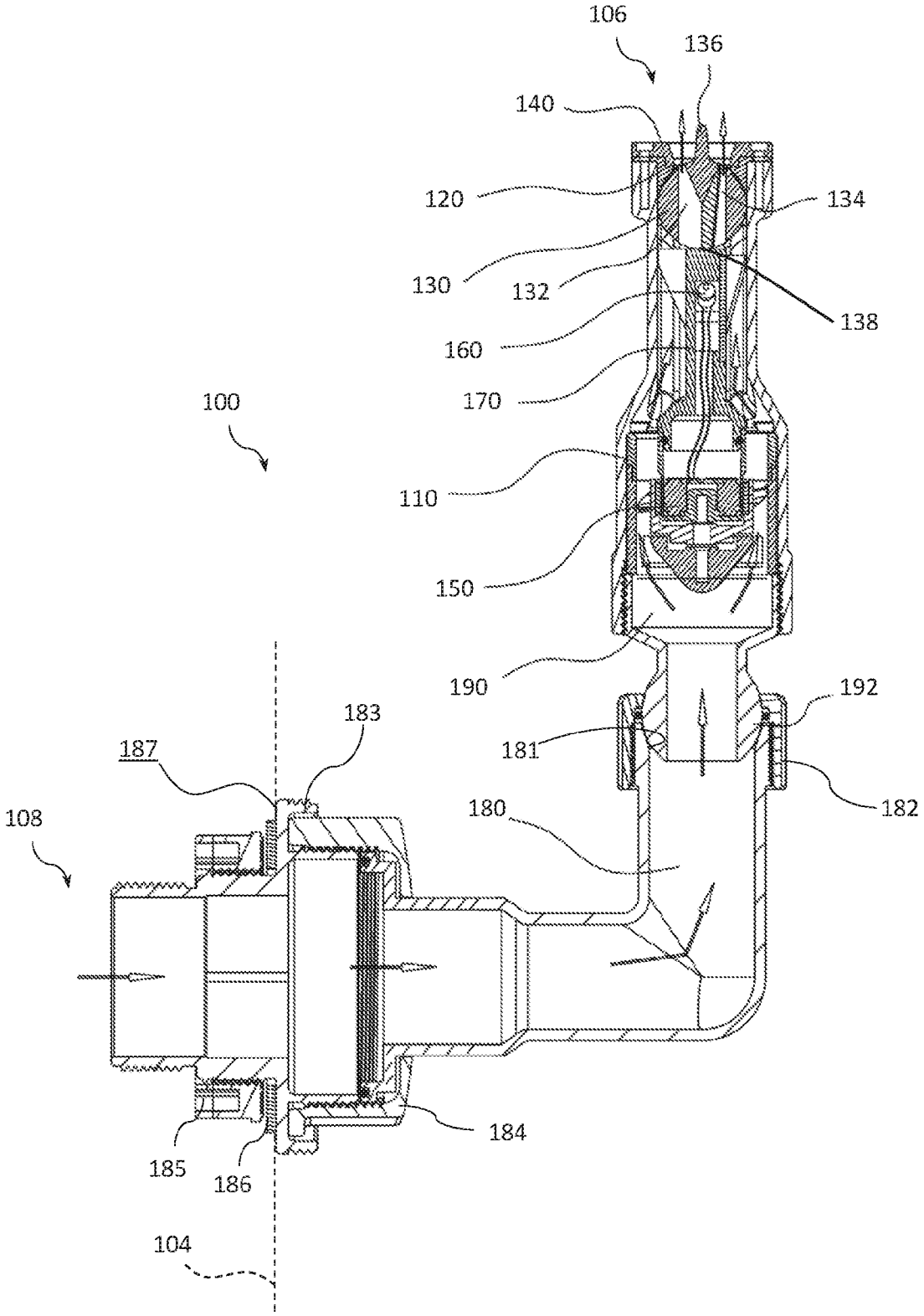
FIG. 4 is a sectional view of the L-shaped water sprayer of FIG. 3 when a water sprout passage and a water curtain passage are open.

As shown in FIGS. 2-4, the illustrative water sprayer outlet mechanism 100 is L-shaped and has an outlet or spray end 106 that faces vertically upward and an inlet end 108 that faces horizontally. Water sprayer outlet mechanism 100 includes a sprayer cover 110, a seal 120, an adjusting valve 130, a top cover 140, a power generating component 150, a light source 160 (e.g., LED), a lamp shade 170, an inlet pipe 180, and a connecting element 190.

The illustrative sprayer cover 110 is fan-shaped and has a rectangular or ellipse-shaped outlet 112 that faces vertically upward toward outlet end 106 and a circular-shaped inlet 114 that faces vertically downward. Seal 120, which may be constructed of rubber or another suitable material, is rectangular or ellipse-shaped and is disposed at outlet 112 of sprayer cover 110. Top cover 140 is also disposed at outlet 112 of sprayer cover 110 and cooperates with sprayer cover 110, such as with bolts or other fasteners (not shown), to compress seal 120 therebetween.

Furthermore, the illustrative adjusting valve 130 is cylinder-shaped and defines an internal water spout passage 132 and an internal water curtain passage 134, which are located on opposing sides of lamp shade 170. As discussed further below, adjusting valve 130 is capable of being adjusted to deliver water from outlet end 106 via water spout passage 132, water curtain passage 134, or both, such that water flowing out of water spout passage 132 sprays out as a water spout, and water flowing out of water curtain passage 134 sprays out as a water curtain or sheet. More specifically, adjusting valve 130 is rotatably accommodated in sprayer cover 110 and cooperates with seal 120 to selectively plug and/or open outlet 112 of the sprayer cover 110.

Figure 5:
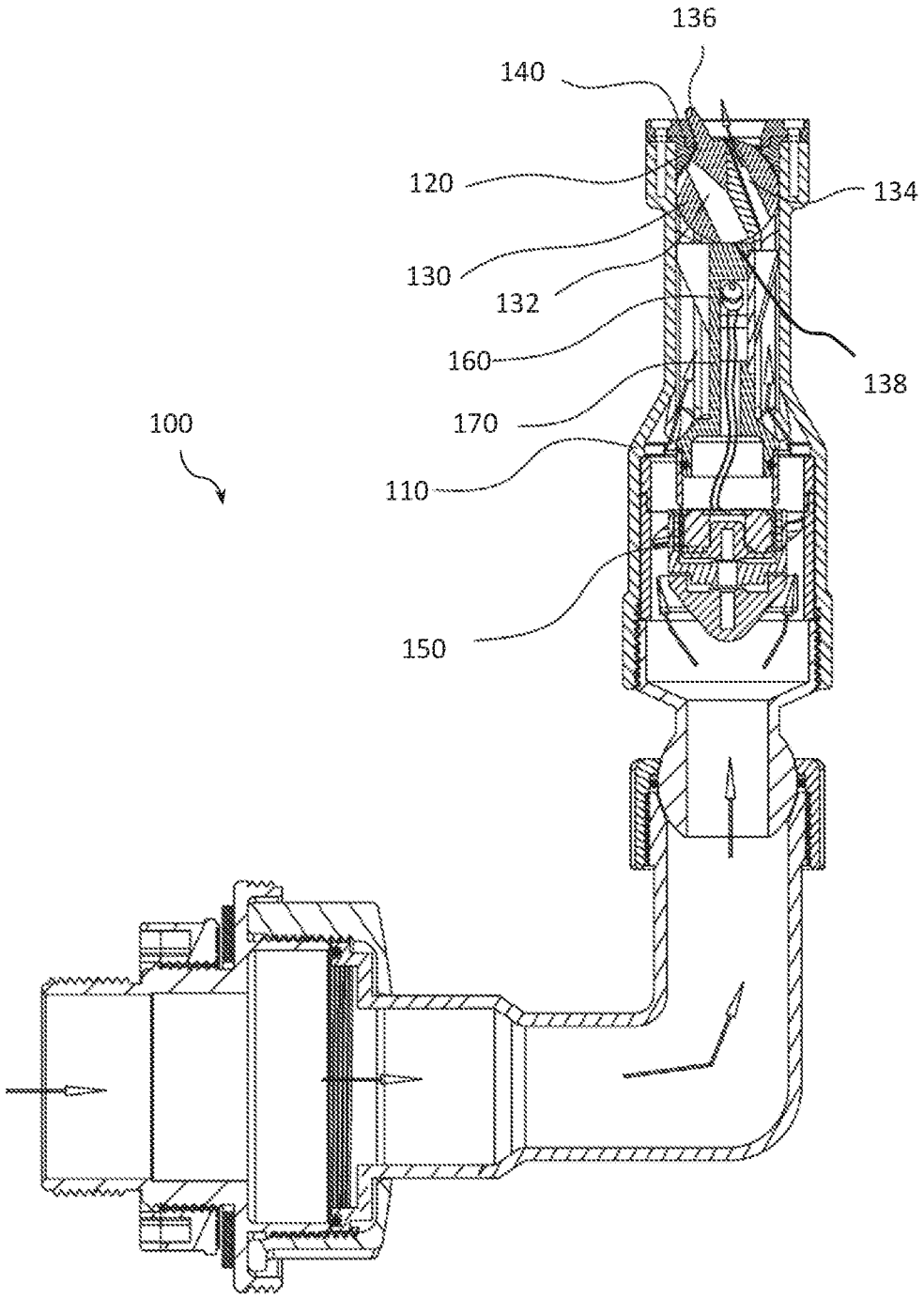
FIG. 5 is a sectional view of the L-shaped water sprayer of FIG. 3 when the water spout passage is closed.
Figure 6:
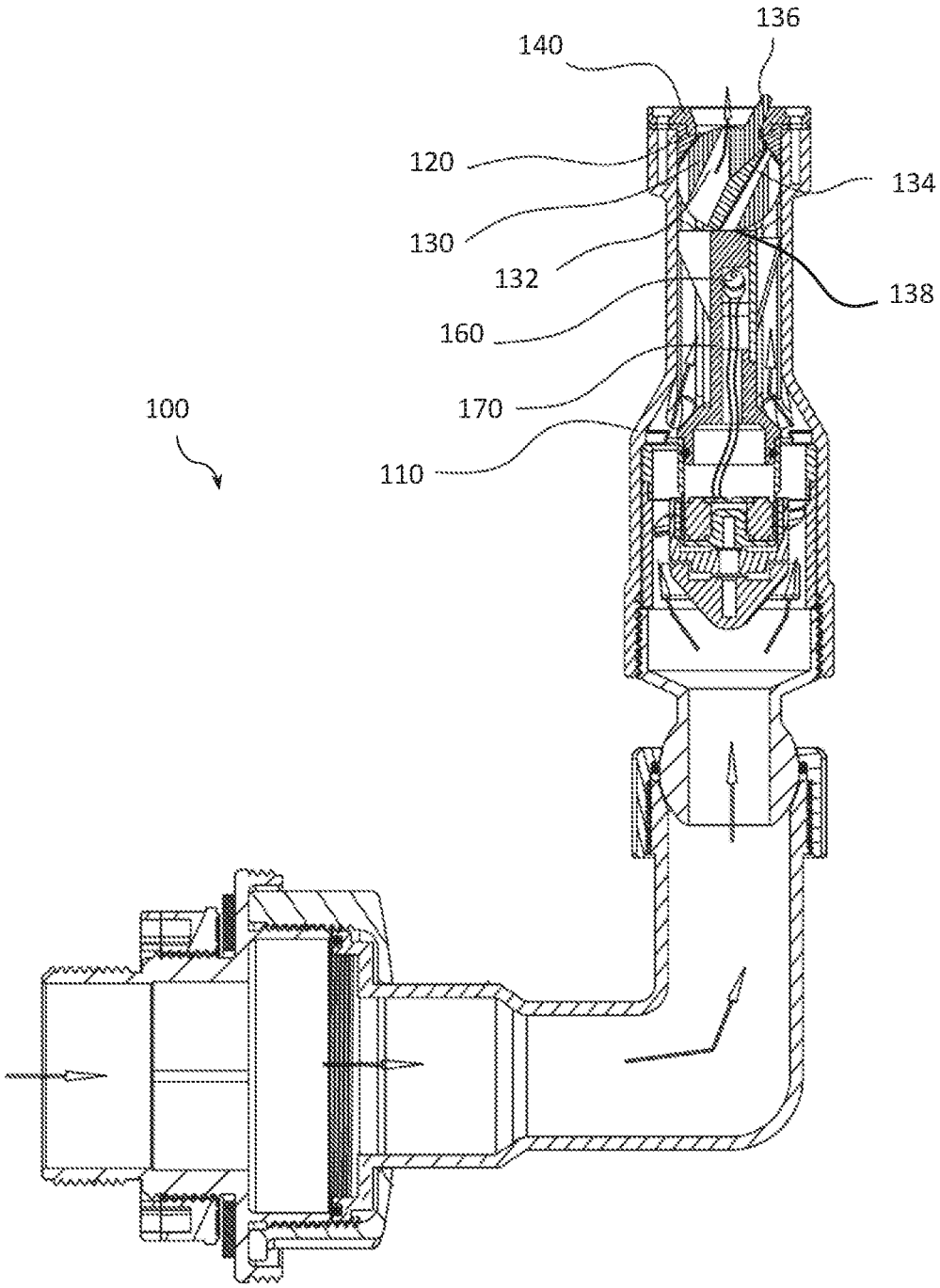
FIG. 6 is a sectional view of the L-shaped water sprayer of FIG. 3 when the water curtain passage is closed.
Figure 7:
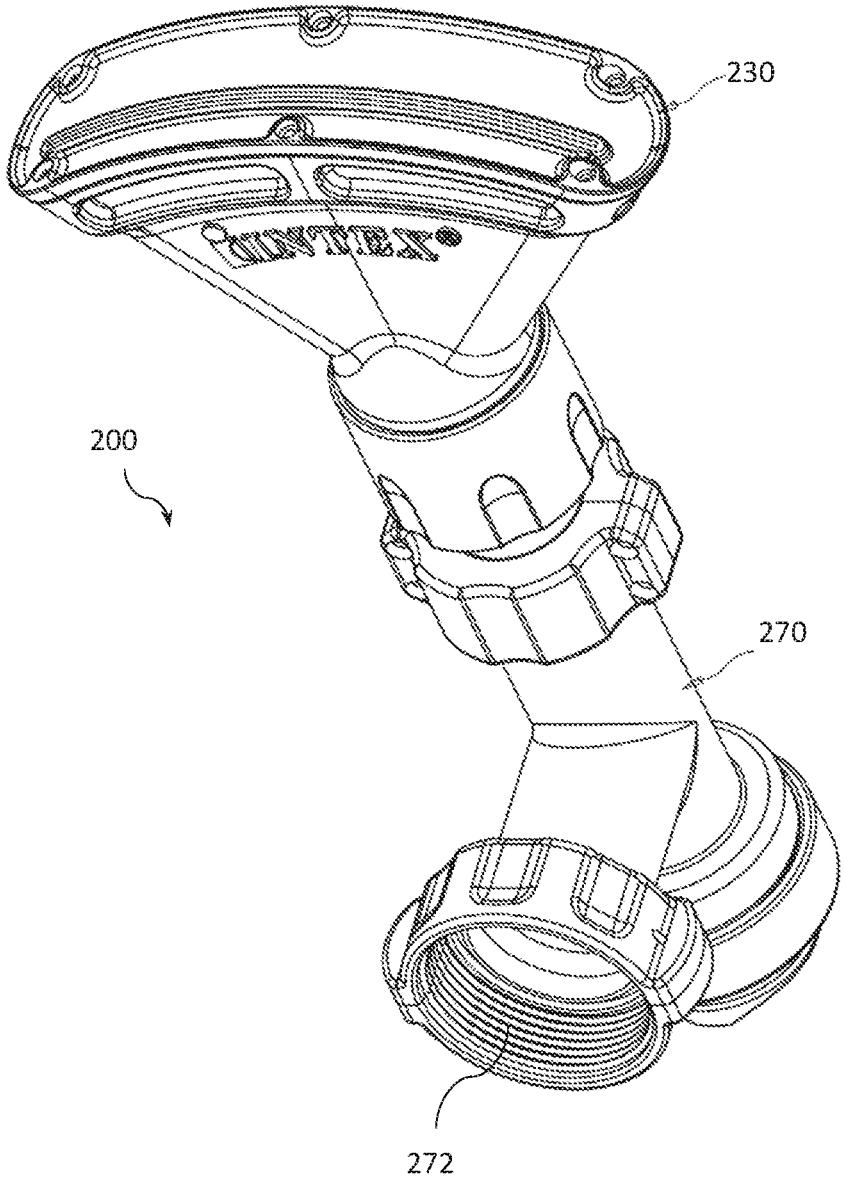
FIG. 7 is a perspective view of an exemplary T-shaped water sprayer.
Figure 8:
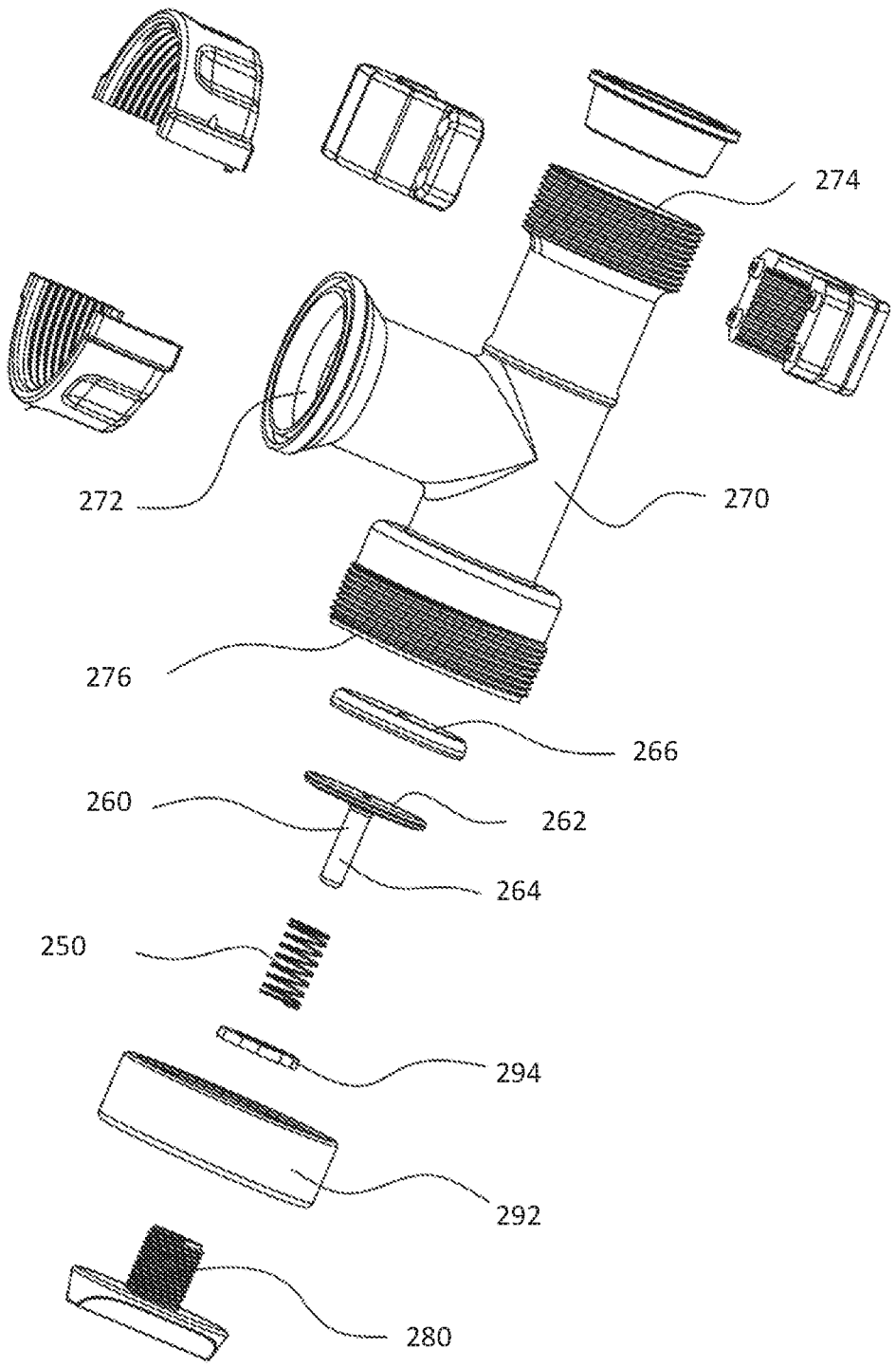
FIG. 8 is an exploded perspective view of part of the T-shaped water sprayer of FIG. 7.

As shown in FIGS. 4-6, adjusting valve 130 further comprises a handle 136, which is disposed between water spout passage 132 and water curtain passage 134. Handle 136 extends outwardly from adjusting valve 130 and through top cover 140 and is used to manually rotate adjusting valve 130, so that seal 120 can toggle between engaging adjusting valve 130 at water spout passage 132, water curtain passage 134, or neither. More specifically, a user may manipulate handle 136 to rotate adjusting valve 130 so that seal 120 closes water spout passage 132 and opens water curtain passage 134, as shown in FIG. 5, such that water only flows through water curtain passage 134. Likewise, the user may manipulate handle 136 to rotate adjusting valve 130 so that seal 120 closes water curtain passage 134 and opens water spout passage 132, as shown in FIG. 6, such that water only flows through water spout passage 134. Alternatively, the user may manipulate handle 136 to rotate adjusting valve 130 to a central position, such that water spout passage 132 and water curtain passage 134 are open at the same time, as shown in FIG. 4.

Returning to FIGS. 2-4, power generating component 150, light source 160, and lamp shade 170 may be disposed in sprayer cover 110. Lamp shade 170 may abut a lower end 138 of adjusting valve 130. Light source 160 is disposed in lamp shade 170, and power generating component 150 is operably connected to light source 160. In operation of an exemplary embodiment, water flowing through sprayer cover 110 may impact power generating component 150, so that power generating component 150 generates power and supplies power to light source 160. Lamp shade 170 may be at least partially translucent to allow light to pass from light source 160, through lamp shade 170, and into the water flowing through sprayer cover 110 so that illuminated water is sprayed from outlet end 106. Light source 160 may be configured to generate one or more colors of light.

The power generating component 150 of water sprayer outlet mechanism 100 may have various features in common with the below-described power generating component 240 of water sprayer outlet mechanism 200. For example, as shown in FIGS. 2 and 4, the illustrative power generating component 150 includes a deflecting cover 151, an impeller 152, a stator 153, a rotor 154, and a motor 156. Additional details regarding power generating component 150 are disclosed below with respect to power generating component 240.

Additionally, an upper end 194 of connecting element 190 is connected to an opening at the bottom inlet 114 of sprayer cover 110. In the illustrated embodiment of FIG. 4, the connecting element 190 is externally threaded and the sprayer cover 110 is internally threaded to form a threaded connection therebetween, but the type of connection may vary. A lower end 196 of connecting element 190 includes a hollow universal ball joint 192. Universal ball joint 192 is pivotally received within a tapered end or socket 181 of the inlet pipe 180 and captured therein by an interlocking retaining ring 182. This pivotal connection allows the user to control the direction of the outgoing water spray from outlet end 106 by moving connecting element 190 relative to inlet pipe 180.

Inlet pipe 180 also includes an adapter 183 configured to connect water sprayer outlet mechanism 100 to a water source. In FIG. 1, the water source is a return hose 102 from pool 101, wherein the water is pumped and optionally filtered and/or heated before returning to pool 101 via return hose 102. Another interlocking retaining ring 184 may be provided to couple adapter 183 to inlet pipe 180. Also, a nut 185 and a seal 186 may be provided to couple adapter 183 to pool 101. In FIG. 4, liner 104 of pool 101 is clamped and sealed between seal 186 on one side and outer face 187 of adapter 183 on the other side. Rather than coupling water sprayer outlet mechanism 100 to liner 104 of pool 101, it is also within the scope of the present disclosure to couple water sprayer outlet mechanism 100 to support structures 105 or 106 of pool 101. In at least one embodiment, the inlet pipe 180 is L-shaped, as shown in FIG. 4, such that the inlet pipe 180 extends horizontally from the pool wall 104 and then vertically upward toward connecting element 190, sprayer cover 110, and other elements located near outlet end 106 of water sprayer outlet mechanism 100.

Figure 9:
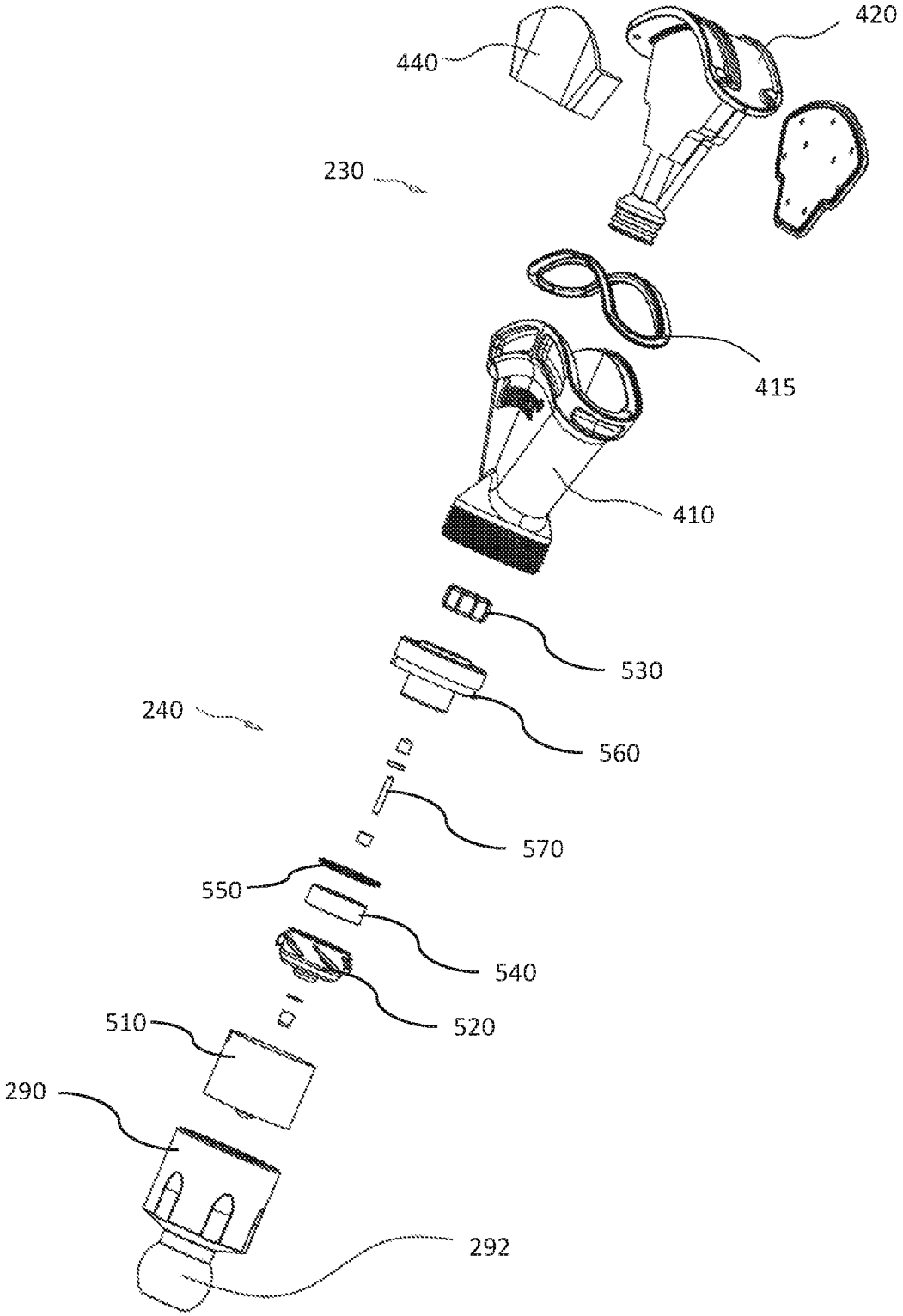
FIG. 9 is an exploded perspective view of another part of the T-shaped water sprayer of FIG. 7.
Figure 10:
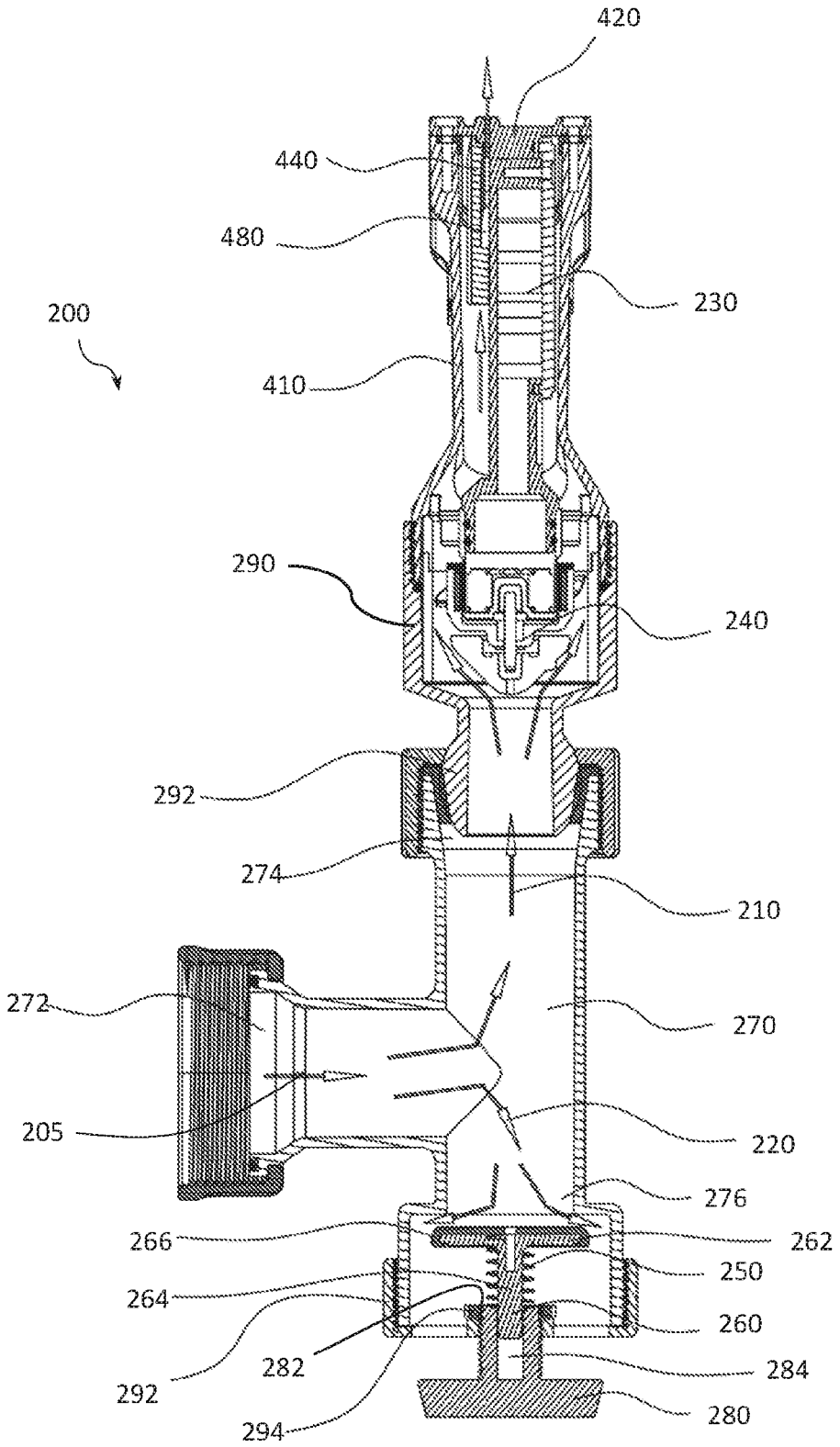
FIG. 10 is a sectional view of the T-shaped water sprayer of FIG. 7.

FIGS. 7-18 provide another embodiment of a water sprayer outlet mechanism 200. As shown in FIG. 10, the illustrative water sprayer outlet mechanism 200 is T-shaped and includes an inlet waterway 205 that extends horizontally from a water source (not shown), an outlet waterway 210 that extends vertically upward from the inlet waterway 205, and a decompression waterway 220 that extends vertically downward from the inlet waterway 205. As described further below, when the water pressure inside water sprayer outlet mechanism 200 is too high, decompression waterway 220 may open automatically to drain excess water and decompress the water pressure inside water sprayer outlet mechanism 200, thus stabilizing the water pressure of outlet waterway 210, so that outlet waterway 210 maintains an even flow rate.

Along outlet waterway 210, water sprayer outlet mechanism 200 may include a light source (e.g., LED) (not shown but similar to the above-described light source 160), an outlet or head component 230, and a power generating component 240 disposed in the water sprayer outlet mechanism 200 and operably connected to the light source (not shown). Power generating component 240 may be disposed in outlet component 230. In operation of an exemplary embodiment, water travels horizontally through inlet waterway 205 and vertically upward through outlet waterway 210 and outlet component 230. Then the water flowing through outlet component 230 impacts power generating component 240, so that power generating component 240 generates power and supplies power to the light source. The light passes from the light source and into the water, and then the illuminated water sprays out of outlet component 230. Outlet component 230 and power generating component 240 are described further below.

At the intersection between inlet waterway 205, outlet waterway 210, and decompression waterway 220, water sprayer outlet mechanism 200 may include a T-shaped guiding pipe 270 comprising an inlet 272, an outlet 274, and a decompression or drainage port 276. As shown in FIG. 10, the inlet 272 is disposed along inlet waterway 205, the outlet 274 is disposed along outlet waterway 210, and the decompression port 276 is disposed along decompression waterway 220.

Along decompression waterway 220, water sprayer outlet mechanism 200 may include an elastic element 250 (e.g., spring), a valve spool 260 used to open and close decompression waterway 220, a knob 280, a fixation nut 292, and a trimming nut 294. Additionally, valve spool 260 is T-shaped and includes a sealing end cover 262 connected to a guiding column 264. Sealing end cover 262 is sleeved with a sealing pad 266, and valve spool 260 is aligned along the central axis of decompression port 276. Elastic element 250 is sleeved on the guiding column 264. Fixation nut 292 is connected to decompression port 276 of guiding pipe 270. Knob 280 is threaded and connected to fixation nut 292, such that a lower portion 282 of knob 280 abuts elastic element 250. Knob 280 further includes a hole 284 corresponding to guiding column 264. Trimming nut 294 is threaded and connected on lower portion 282 of knob 280 to abut elastic element 250.

By rotating knob 280, the user may move lower portion 282 of knob 280 upward to compress elastic element 250 or downward to release elastic element 250, such that elastic element 250 applies an adjustable force to valve spool 260 toward outlet waterway 210. When the water pressure in the outlet waterway 210 is at or below the user's preselected level, elastic element 250 forces valve spool 260 upward to close decompression waterway 220, so water flows through outlet waterway 210 and out of water sprayer outlet mechanism 200. When the water pressure in the outlet waterway 210 is above the user's preselected level, the water pressure on valve spool 260 is higher than the force applied to valve spool 260 by elastic element 250, so that the valve spool 260 and, more specifically, guiding column 264 is pushed downward into knob hole 284, thereby opening the decompression waterway 220.

Water sprayer outlet mechanism 200 may have various features in common with the previously-described water sprayer outlet mechanism 100. For example, as shown in FIGS. 9 and 10, water sprayer outlet mechanism 200 may include a connecting element 290 with a universal ball joint 292 for rotatably coupling outlet component 230 to guiding pipe 270.

Figure 11:
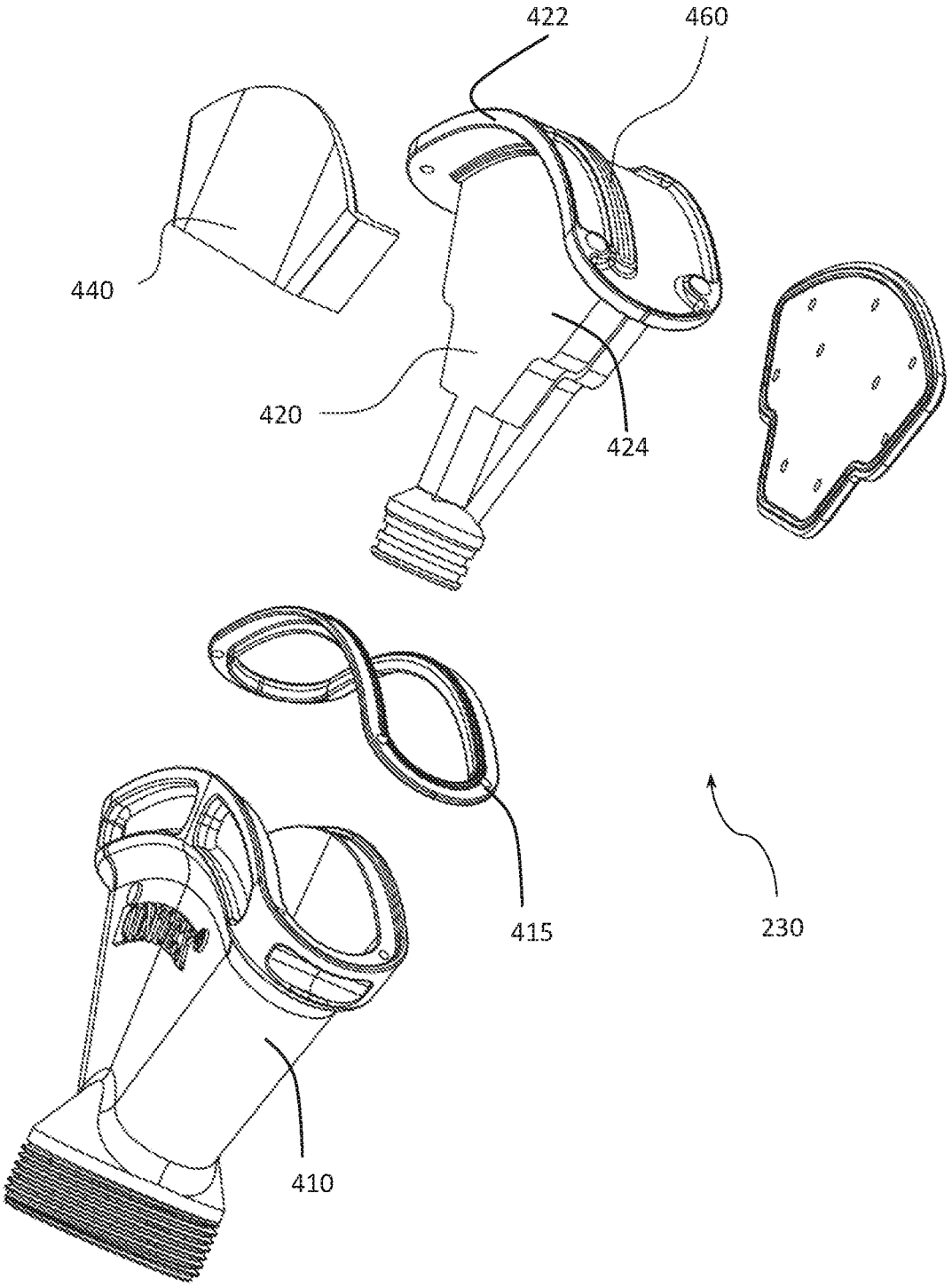
FIG. 11 is an exploded perspective view of a water sprayer head of the T-shaped water sprayer of FIG. 7.
Figure 12:
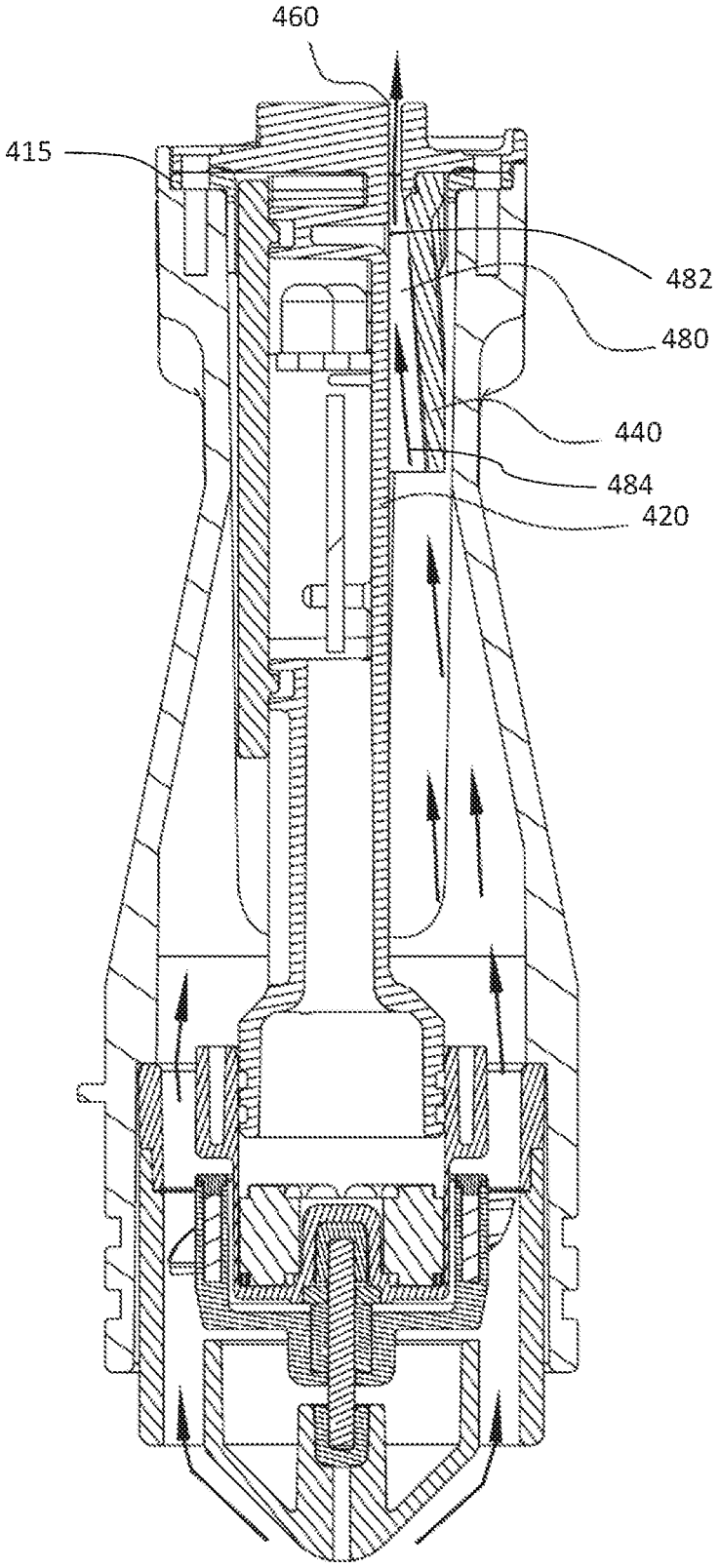
FIG. 12 is a sectional view of the water sprayer head of FIG. 11.

An exemplary outlet component 230 is now described in more detail with reference to FIGS. 11 and 12. Outlet component 230 may include a sprayer cover 410, a seal 415, a lampshade 420 configured to receive the light source, and a guiding or deflecting plate 440. A top surface 422 of lampshade 420 is arc-shaped and includes an elongated outlet nozzle 460. Deflecting plate 440 cooperates with a side 424 of lampshade 420 to define a water spray passage 480. Water spray passage 480 has a tapered or conical shape with narrow top 482 and wide bottom 484. Top 482 of water spray passage 480 is connected to elongated outlet nozzle 460, such that water flows through water spray passage 480 and sprays out of elongated outlet nozzle 460 to form a water sheet of substantially even thickness.

Figure 13:
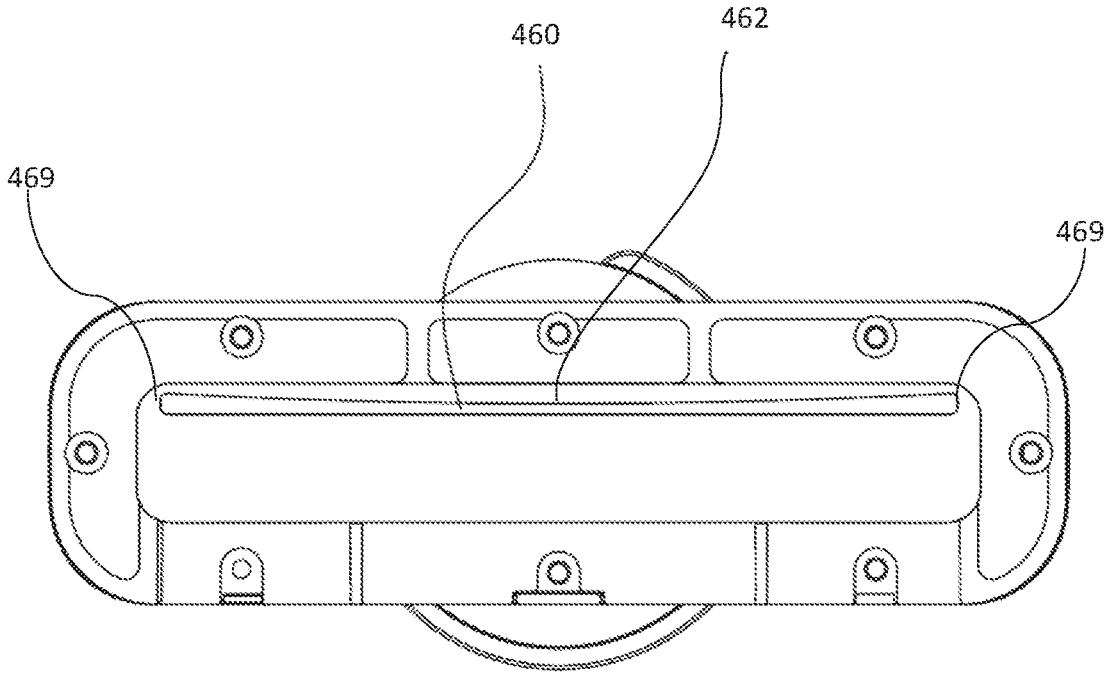
FIG. 13 is an end view of the water sprayer head of FIG. 11.
Figure 14:
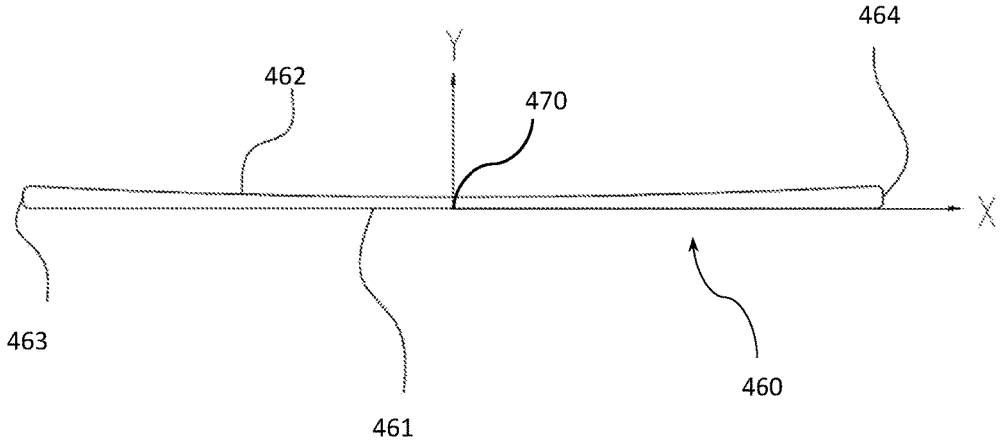
FIG. 14 is a schematic diagram of an outlet nozzle of the water sprayer head of FIG. 11 when projected or expanded in a horizontal plane.
Figure 15:
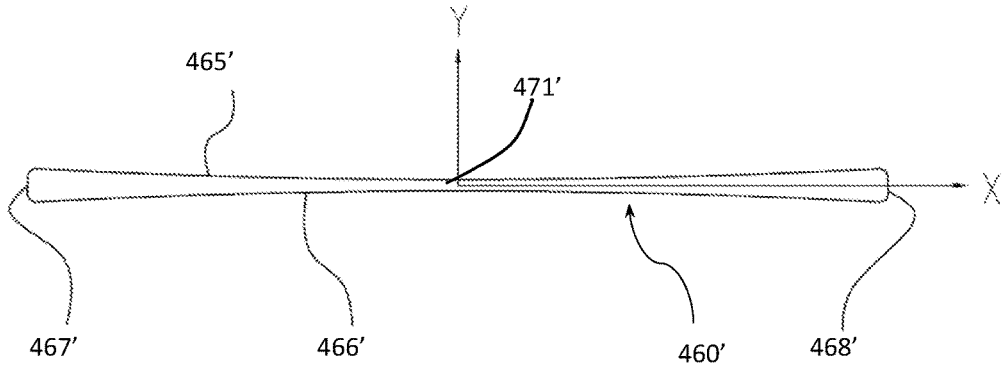
FIG. 15 is another schematic diagram of the outlet nozzle of the water sprayer head of FIG. 11 when projected or expanded in the horizontal plane.

Referring next to FIGS. 13-15, elongated outlet nozzle 460 may be bilaterally symmetrical about a central axis and have a width that is gradually larger from a center 462 to outer ends 469, so as to maintain a consistent thickness of an outlet water sheet.

As shown in FIG. 14, elongated outlet nozzle 460 has an elongated, thin hole shape defined by a lateral straight line section 461, a lateral curved line section 462, a left end connecting line section 463, and a right end connecting line section 464 when projected or expanded in a horizontal plane. When creating a plane coordinate system in a horizontal plane, the lateral X-axis of the coordinate system tracks lateral straight line section 461, the central Y-axis extends parallel to and between the left and right end connecting line sections 463 and 464, and the origin of the coordinate system is located at a midpoint 470 of lateral straight line section 461. In an exemplary embodiment, curve line section 462 is calculated with formula: $Y=a_4x^4+a_2x^2+a_0$; wherein $a_0\geq 1$, $10^{-5}\geq a_4\geq 10^{-12}$, and $10^{-2}\geq a_2\geq 10^{-6}$. In another exemplary embodiment, $a_0=1.5$, $10^{-7}\geq a_4\geq 7*10^{-10}$, and $1.4*10^{-3}\geq a_2\geq 3*10^{-4}$. In yet another exemplary embodiment, $a_0=1.5$, $a_4=9*10^{-10}$, and $a_2=5*10^{-4}$.

The process for deriving $Y=a_4x^4+a_2x^2+a_0$ is as follows: The system flow Q and the expected water sheet width H, which corresponds to the physical width of elongated outlet nozzle 460, are known. At a certain flow rate V, the section area S of elongated outlet nozzle 460 is determined using a known calculus method to determine the curvilinear formal $Y=a_4x^4+a_2x^2+a_0$. More specifically, according to the Fourier function for determining a curvilinear equation, the general equation is $Y=a_{2n}x^{2n}+a_{2n-1}x^{2n-1}+\ldots+a_4x^4+a_3x^3+a_2x^2+a_1x+a_0$. If the curvilinear equation is symmetrical about the Y-axis, as in the exemplary embodiment, the odd power factors are: 0, $a_{2n-1}=0, \ldots, a_3=0, a_1=0$. Further, according to known water viscosity and curvilinear correlation properties, the number of power factors is under 5, such that $Y=a_4x^4+a_3x^3+a_2x^2+a_1x+a_0$. Thus, because elongated outlet nozzle 460 is symmetrical about Y-axis, $a_3=0$ and $a_1=0$, then $Y=a_4x^4+a_2x^2+a_0$. Thus, if the expected water sheet width H, which corresponds to the physical width of elongated outlet nozzle 460, is 120 mm, the water flow rate V is between 2 m/s, the system volumetric flow rate Q is 550 GPH in a certain lift, the section area of elongated outlet nozzle 460 is S, where:

$$S=\frac{Q}{V}=\frac{550*3.78546}{1000*3600*2}=0.000289\ \text{m}^2=289\ \text{mm}^2$$

As shown in FIG. 15, another elongated outlet nozzle 460' is both bilaterally symmetrical about the central Y-axis and longitudinally symmetrical about the lateral X-axis. Elongated outlet nozzle 460' has an elongated, thin hole shape defined by an upper curve line section 465', a lower curve line section 466', a left end connecting line section 467', and a right end connecting line section 468' when projected or expanded in a horizontal plane. When creating a plane coordinate system in a horizontal plane, the X-axis of the coordinate system is located at a line of symmetry between upper curve line section 465' and lower curve line section 466', the origin of the coordinate system is located at a midpoint 471' between upper curve line section 465' and lower curve line section 466'. Upper curve line section 465', for example, is calculated with the following formula: $Y=a_4x^4+a_2x^2+a_0$; wherein $a_0\geq 1$, $5*10^{-6}\geq a_4\geq 5*10^{-13}$, and $5*10^{-3}\geq a_2\geq 5*10^{-7}$. In another exemplary embodiment, $a_0=1.5$, $5*10^{-8}\geq a_4\geq 3.5*10^{-10}$, and $7*10^{-4}\geq a_2\geq 1.5*10^{-4}$ In yet another exemplary embodiment, $a_0=1.5$, $a_4=4.5*10^{-10}$, and $a_2=2.5*10^{-4}$.

Figure 16:
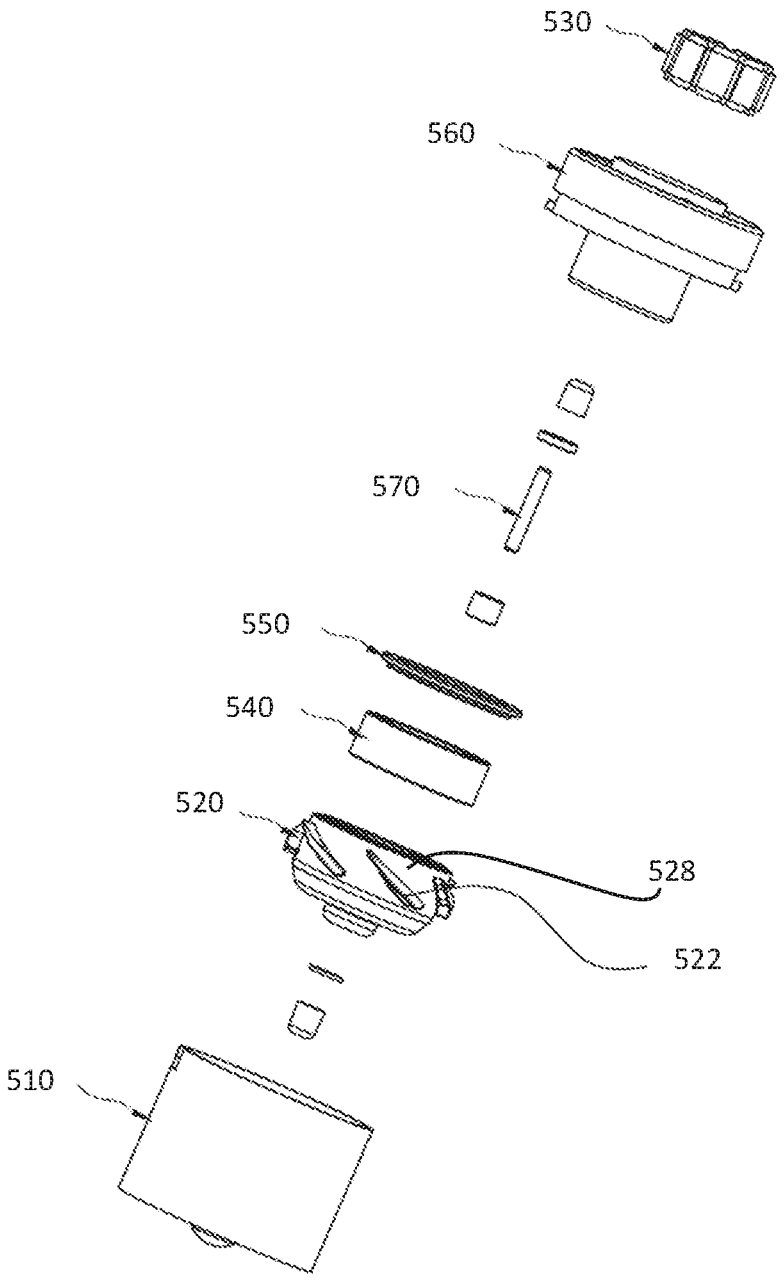
FIG. 16 is an exploded perspective view of an exemplary impeller speed-up mechanism of the T-shaped water sprayer of FIG. 7.

An exemplary power generating component 240 is now described in more detail with reference to FIGS. 16-18. Power generating component 240 may include an impeller 520, a stator 530, a rotor 540, an annular end cover 550, a motor 560, and a center shaft 570. Power generating component 240 may further include a deflecting cover 510 coupled to motor 560 and disposed such that an inlet passage 512 runs vertically through deflecting cover 510. Impeller 520 is rotatably disposed in inlet passage 512. An outer periphery surface 528 of impeller 520 includes a plurality of blades 522, which are adjacent to an outlet port 511 of inlet passage 512 and are inclined to the left with respect to an axis running parallel to inlet passage 512. A plurality of deflection plates 514 is evenly disposed in inlet passage 512 in the circumferential direction. Deflection plates 514 are adjacent to an inlet port 513 of inlet passage 512 and are inclined to the right with respect to an axis running parallel to inlet passage 512. Deflection plates 514 can change the water flow direction to make the water more directly impact blades 522. In the illustrated embodiment of FIG. 17, an intersection angle $\alpha$ of blade 522 and an axis running parallel to inlet passage 512 is arranged at approximately 55-65 degrees, and an intersection angle $\beta$ of deflection plate 514 and an axis running parallel to inlet passage 512 is arranged at approximately 25-45 degrees, which is less than angle $\alpha$. In this embodiment, the water that impacts deflection plate 514 may impact blade 522 at a substantially perpendicular angle, such as about 70-100 degrees.

Figure 17:
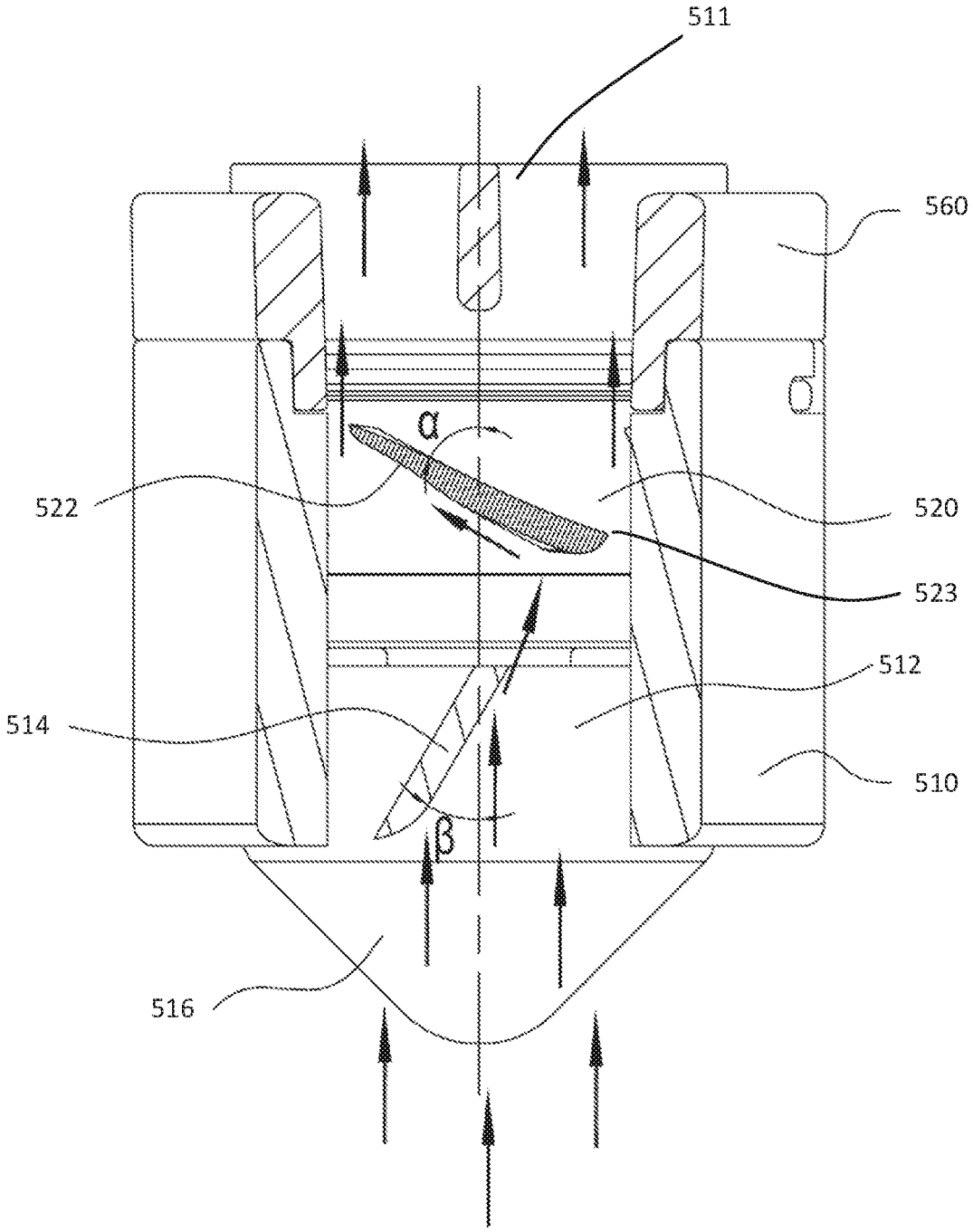
FIG. 17 is a sectional view of an impeller of the impeller speed-up mechanism of FIG. 16.
Figure 18:
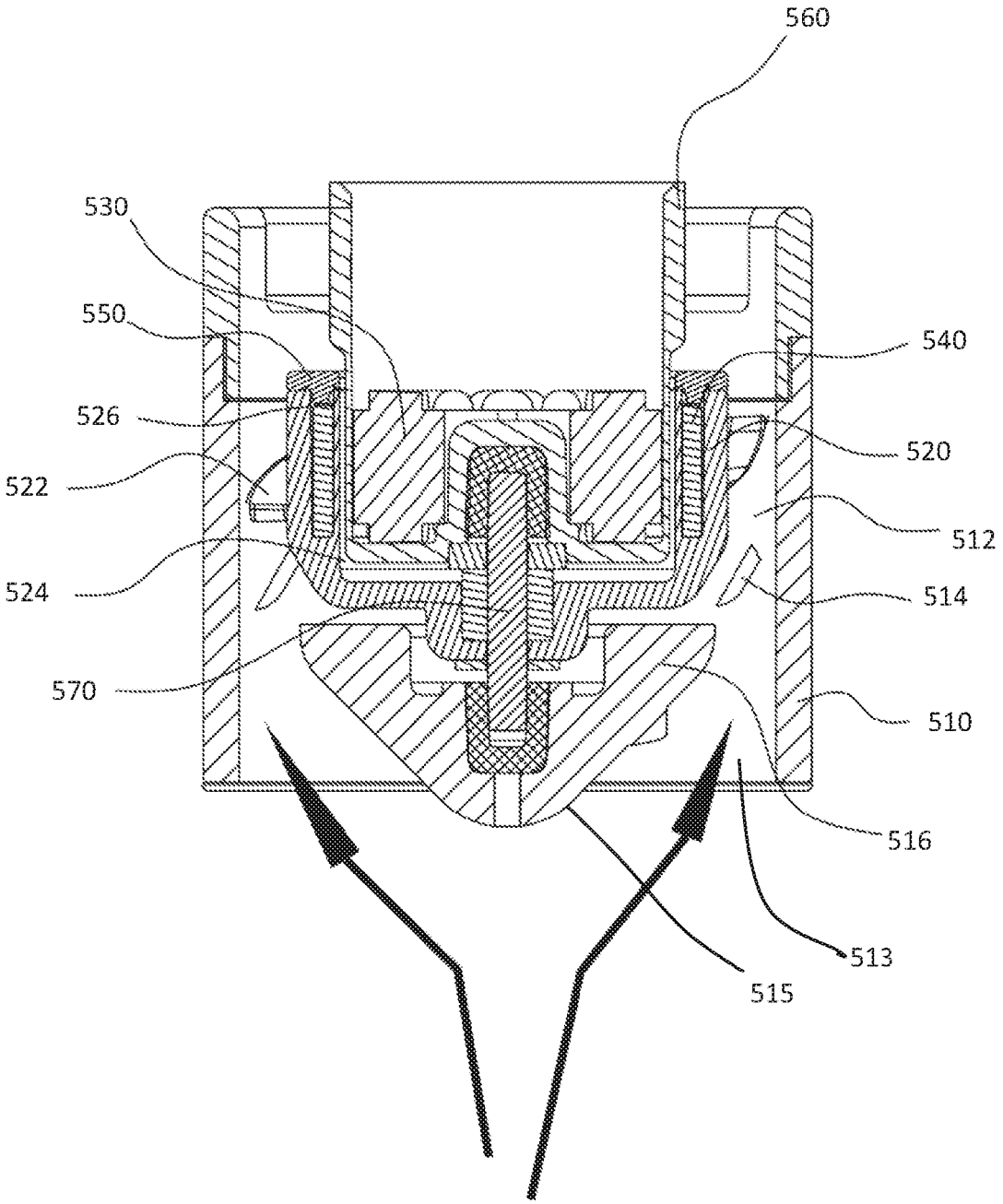
FIG. 18 is another sectional view of the impeller of the impeller speed-up mechanism of FIG. 15.

Referring to FIGS. 17 and 18, the thickness of blades 522 may be gradually larger from the upper end to the lower end 523. The thicker lower end 523 may have an arc-shaped surface that faces downward toward the deflection plate 514. The side of the deflecting cover 510 at the inlet port 513 of inlet passage 512 also includes a water diversion body 516. The exterior surface 515 of water diversion body 516 is a conical surface, such that water diffuses around diversion body 516 to impact the deflection plates 514 at a substantially perpendicular angle by the guiding of the water diversion body 516, and then diffuses around deflection plates 514 to impact blades 522 at a substantially perpendicular angle by the guiding of deflection plates 514.

Referring to FIG. 18, impeller 520 includes a stator cavity 524 and a rotor cavity 526. Rotor cavity 526 is annular-shaped and surrounds stator cavity 524. Stator 530 is located in stator cavity 524, and rotor 530 is located in rotor cavity 526. Annular end cap 550 is disposed to cover the rotor cavity 526. Motor 560 is inserted in stator cavity 524, and stator 530 is disposed in motor 560. Impeller 520 is disposed on center shaft 570, which is connected to deflecting cover 510 and motor 560.

FIGS. 19-26 provide a further embodiment of a water sprayer outlet mechanism, specifically a water sheet sprayer outlet mechanism 300.

Figure 19:
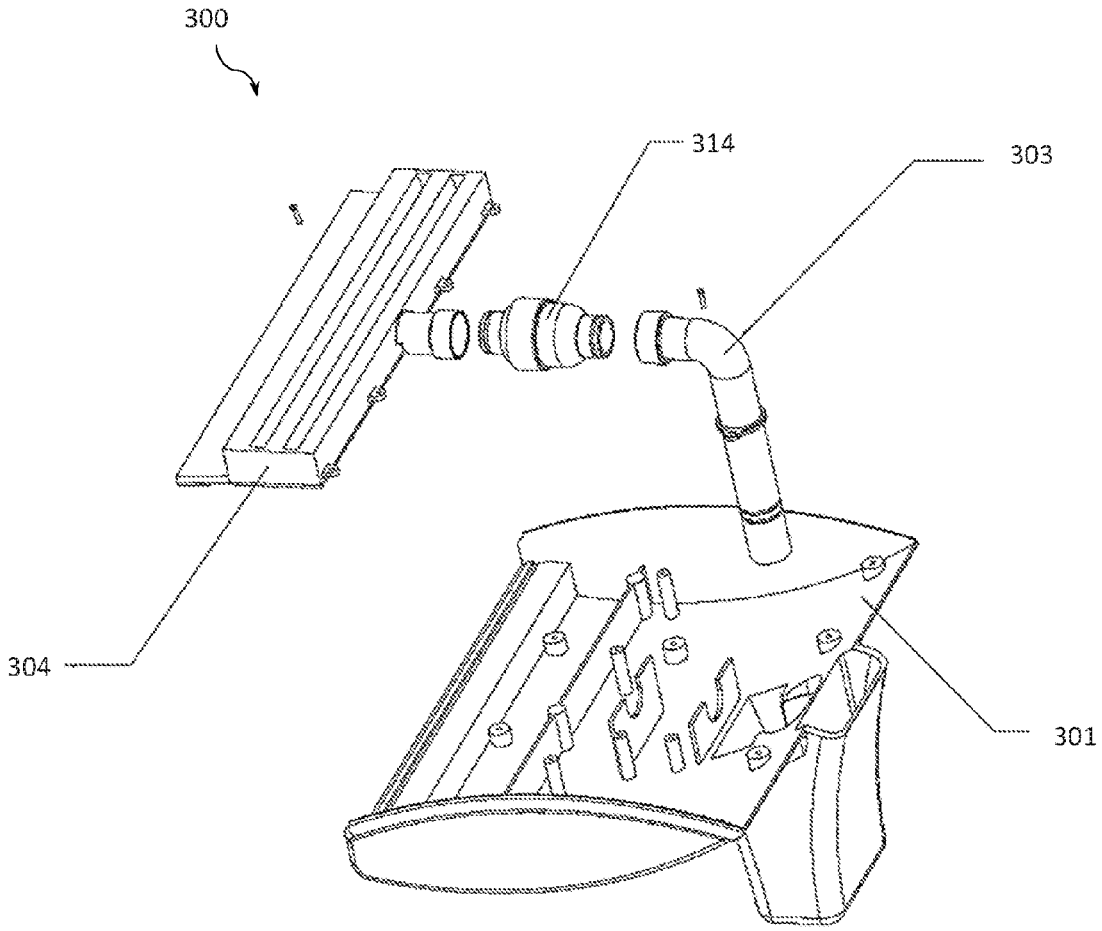
FIG. 19 is an exploded perspective view of an outlet mechanism of an exemplary water sheet sprayer.
Figure 20:
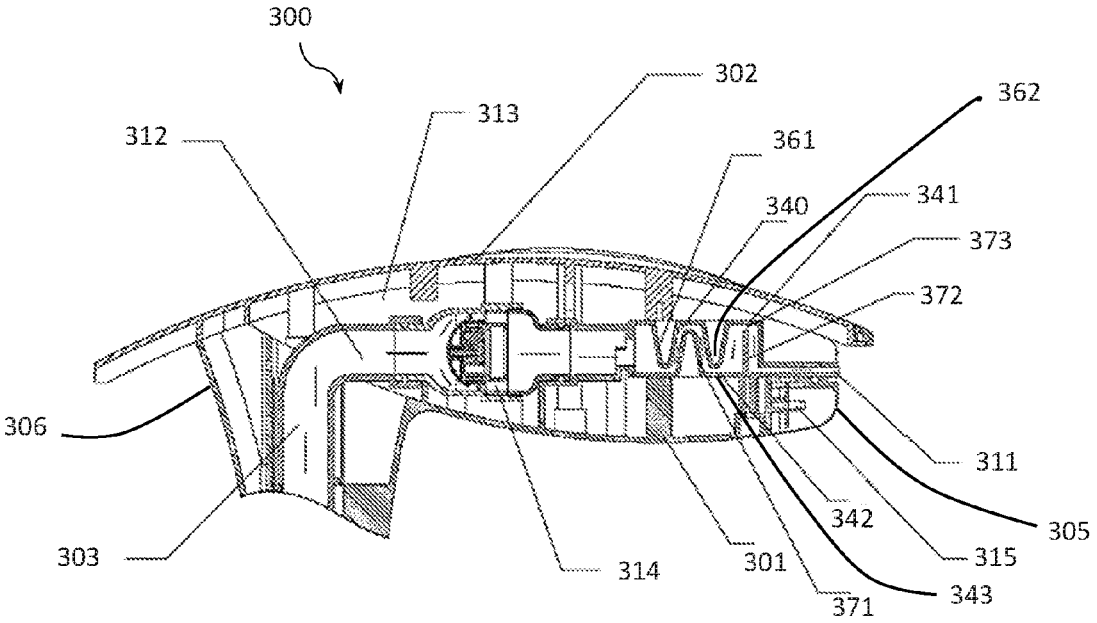
FIG. 20 is a sectional view of the water sheet sprayer of FIG. 19.

Referring to FIGS. 19 and 20, water sheet sprayer outlet mechanism 300 may include a lower main body 301, an upper cover plate 302, an L-shaped water pipe 303, and a rectifying chamber 304. A front or outlet end 305 of main body 301 cooperates with cover plate 302 to form an elongated horizontal outlet 311. A rear or inlet end 306 of main body 301 is configured to receive water pipe 303, which includes inlet 312. Between the front end 305 and the rear end 306, main body 301 cooperates with cover plate 302 to define a hollow chamber 313, so as to connect inlet 312 and elongated outlet 311.

Rectifying chamber 304 is disposed in the hollow chamber 313 and connected between inlet 312 and elongated outlet 311. Additionally, rectifying chamber 304 includes an upper cover 341 and a lower cover 342 that cooperate to define wavy sub-hollow chambers 340. Upper cover 341 includes at least a first protrusion 361, which may extend toward lower cover 342. In an exemplary embodiment, upper cover 341 also includes a third protrusion 362, although it may include more than the two protrusions 361, 362 shown in FIG. 20. Lower cover 342 includes at least a second protrusion 371, which may extend toward upper cover 341, and is staggered between the first protrusion 361 and third protrusion 362. Like upper cover 341, lower cover 342 may include more than the one protrusion 371 shown in FIG. 20. First protrusion 361, second protrusion 371, and third protrusion 362 cooperate to form wavy sub-hollow chambers 340.

A front end 343 of lower cover 342 includes a vertical guard sheet or barrier 372, such that there is a clearance 373 between guard sheet 372 and upper cover 341. Clearance 373 is fluidly connected to wavy sub-hollow chambers 340 on one side and elongated outlet 311 on the other side with elongated outlet 311 at a lower position than clearance 373. In this embodiment, the water exiting wavy sub-hollow chambers 340 travels upward, over guard sheet 372, and back downward to outlet 311. As described, water is stabilized by the buffering and diffusing of the sub-hollow chambers 340 and guard sheet 372 and flows out of elongated outlet 311 evenly, thus forming a substantially flat water sheet instead of a column of water. In operation of the exemplary embodiment, water flows evenly and is not limited by the inlet water volume or flow rate or the particular turbulence characteristics of an inlet water flow in inlet 312 of water pipe 303. Thus, the water output of the water sheet sprayer outlet mechanism 300 appears linear and attractive.

Furthermore, water sheet sprayer outlet mechanism 300 may have other features in common with the previously-described water sprayer outlet mechanism 100 and/or water sprayer outlet mechanism 200. For example, water sheet sprayer outlet mechanism 300 may include a power generating component 314 (which may be the same as or similar to the previously-described power generating components 150 and 240) and a light source 315 (which may be the same as or similar to the previously-described light source 160). In the illustrated embodiment of FIG. 20, power generating component 314 is disposed between the inlet 312 and rectifying chamber 304, and light source 315 is disposed below elongated outlet 311.

Figure 21:
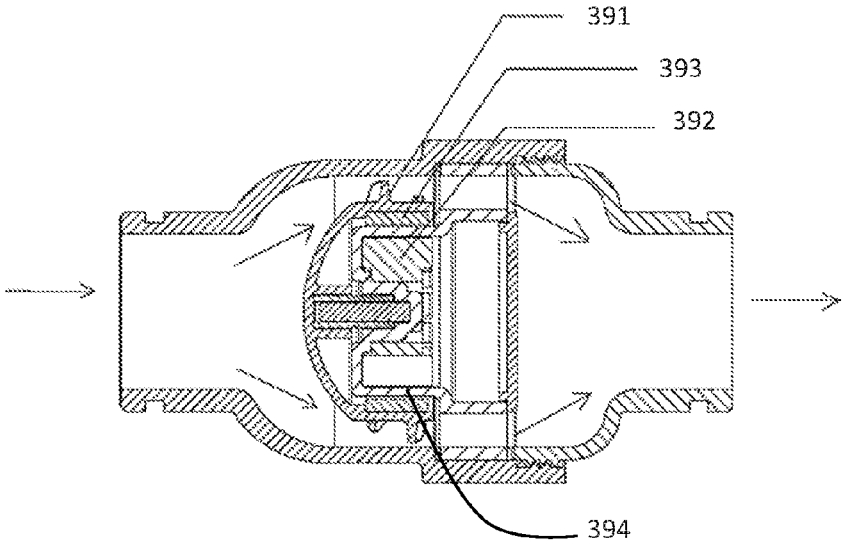
FIG. 21 is a sectional view of a hydropower generating device of the water sheet sprayer of FIG. 19.

Referring to FIG. 21, a first power generating component 314 may include an impeller 391, a stator 392 and a rotor 393. Stator 392 is assembled to a fixing rack 394 such that it is separated from the water flow, and rotor 393 is assembled to impeller 391. The water flow from inlet 312 impacts impeller 391 in the longitudinal direction to drive impeller 391 and rotate rotor 393, which generates voltage as the rotating magnetic field cuts the three-phase winding of stator 392. The voltage generated is then supplied to and powers light source 315 of FIG. 20.

Figure 22:
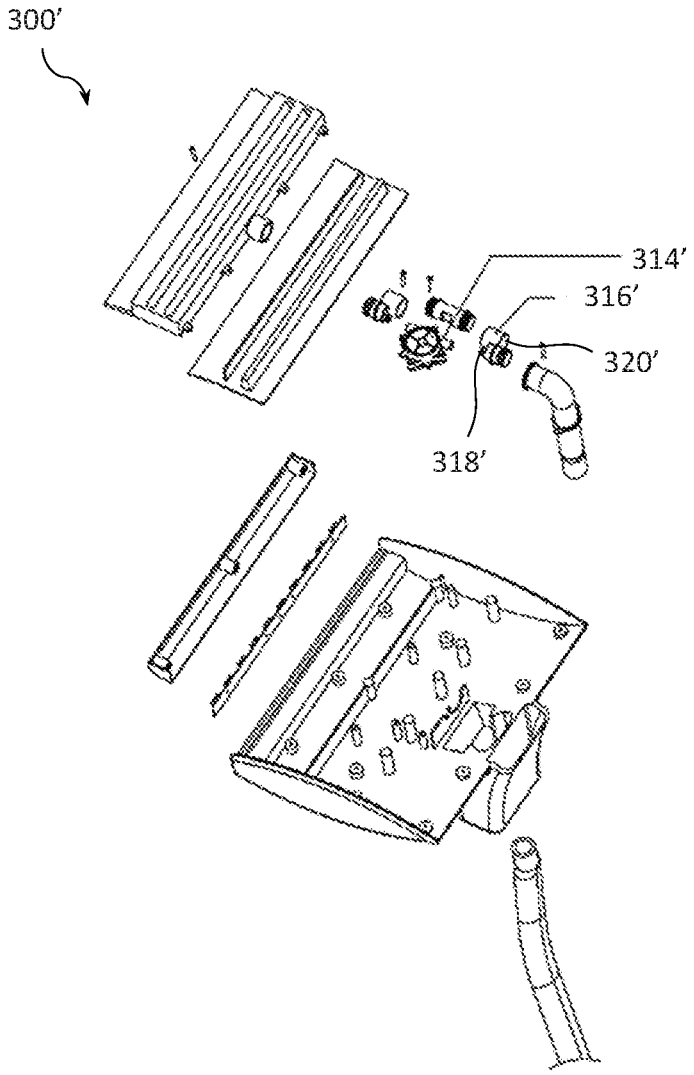
FIG. 22 is an exploded perspective view of an outlet mechanism of another exemplary water sheet sprayer.
Figure 23:
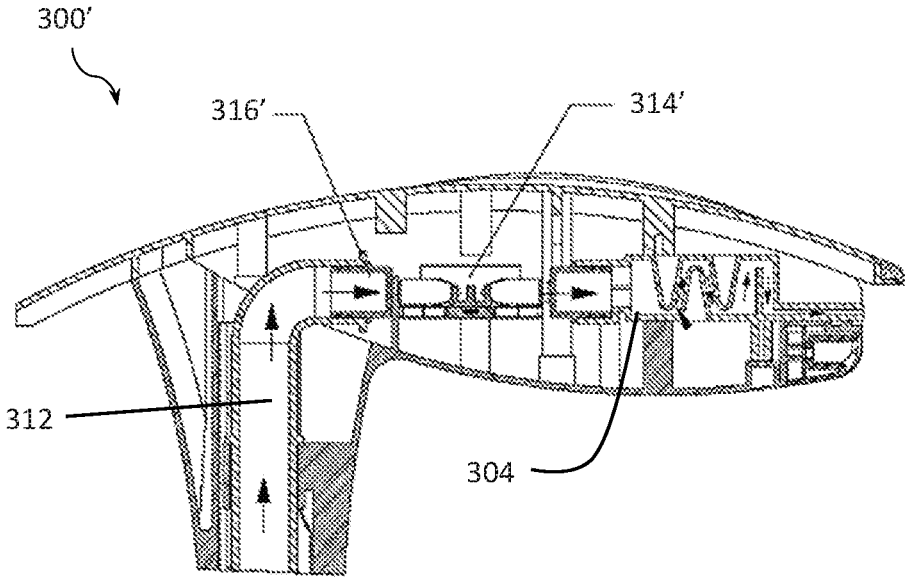
FIG. 23 is a sectional view of the outlet mechanism of the water sheet sprayer of FIG. 22.
Figure 24:
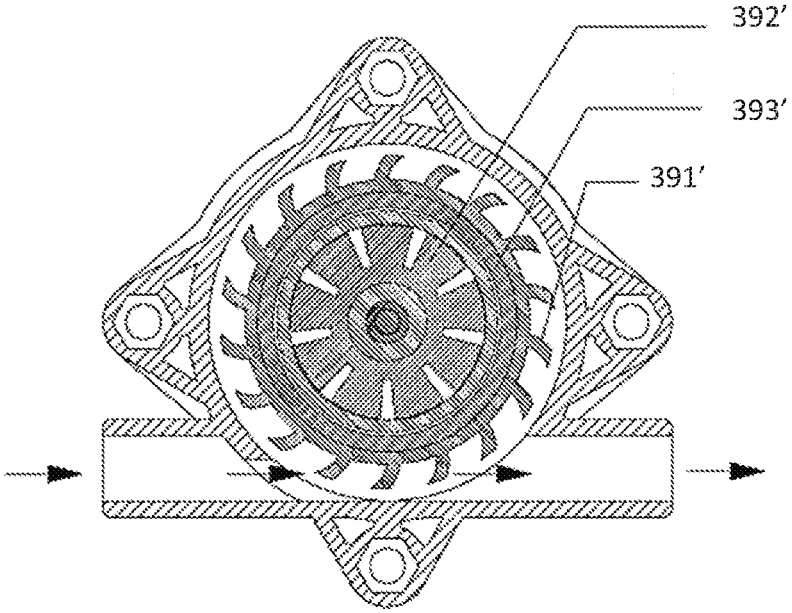
FIG. 24 is a sectional view of a hydropower generating device of the water sheet sprayer of FIG. 22.

Referring next to FIGS. 22-24, an alternative power generating component 314' is disclosed in which water flow impacts impeller 391' in a tangential direction to drive impeller 391' to rotate rotor 393'. Because the water flow impacting impeller 391' in a tangential direction is slight, and in order to maintain a water sheet outlet effect, inlet 312 of water pipe 303 is connected to a diversion pipe 316' having two outlets 318', 320' to form two water flows (FIG. 22). One water flow from outlet 318' enters the rectifying chamber 304 after impacting the impeller 391' in the tangential direction, and the other water flow from outlet 320' bypasses the impeller 391' and directly enters the rectifying chamber 304.

Figure 25:
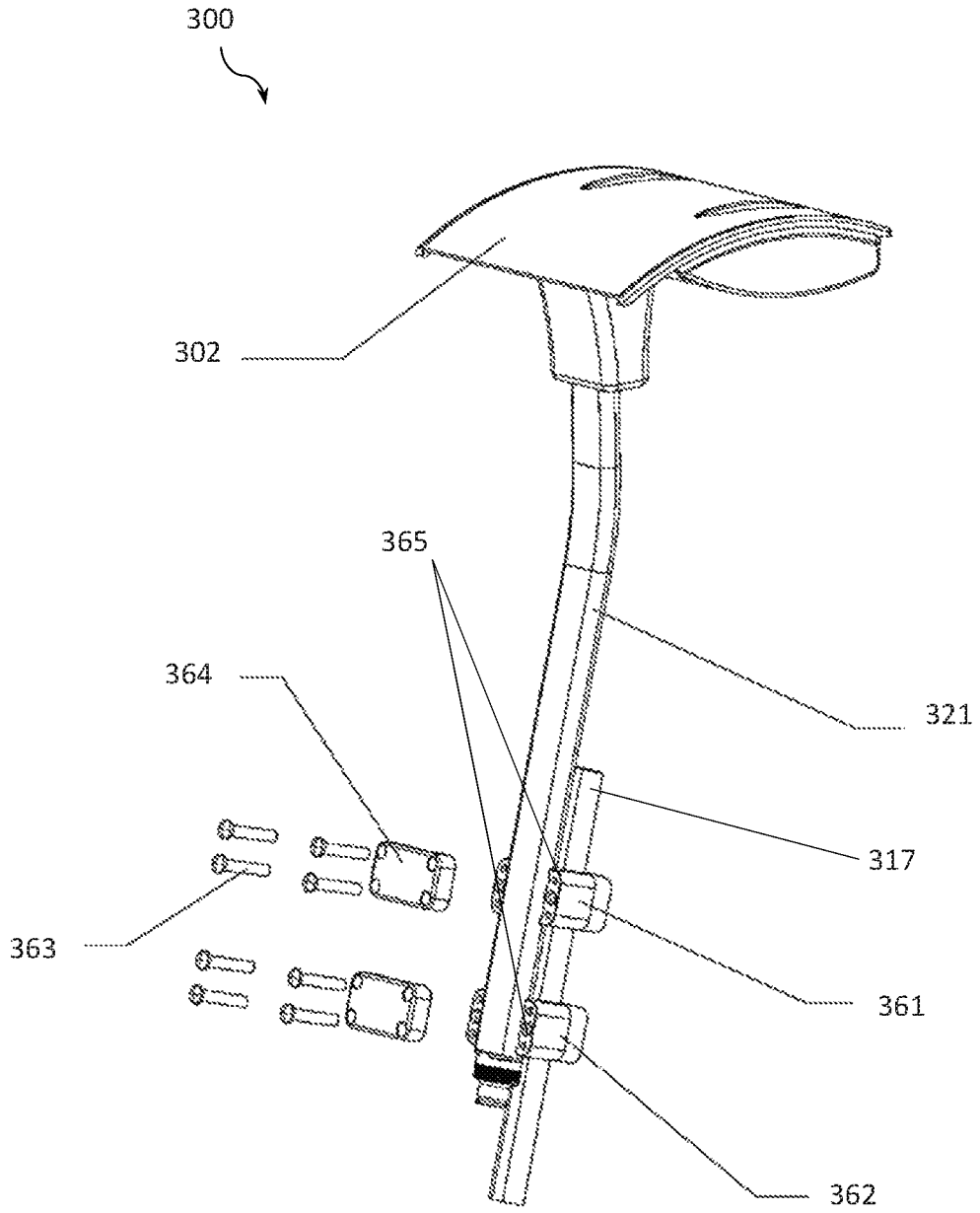
FIG. 25 is a partially assembled perspective view of the water sheet sprayer of FIG. 19.
Figure 26:
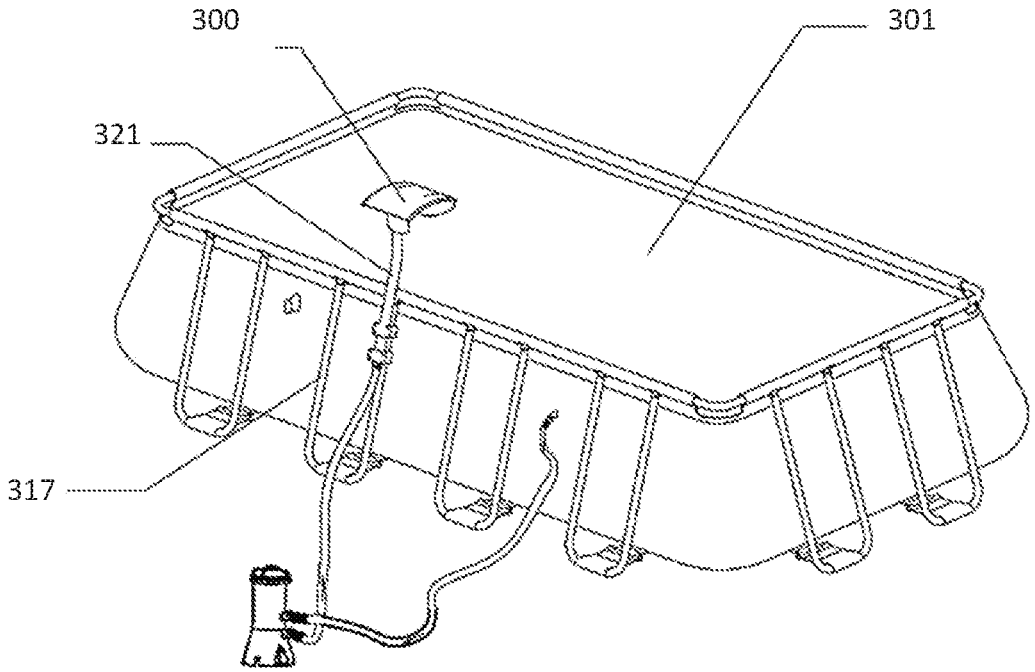
FIG. 26 is a perspective view of a pool with the water sheet sprayer of FIG. 19.

Referring next to FIGS. 25 and 26, water sheet sprayer outlet mechanism 300 may be connected to a support leg 317 or another component of pool 301, such as the liner or the upper annular support structure. As shown in FIG. 18, support leg 317 has an upper fixing board or bracket 361 and a lower fixing board or bracket 362 each having a groove 365 that is configured to receive water pipe 321. Water pipe 321 is placed in grooves 365 and is fixed in grooves 365 via bolts 363 and clamping structures 364 that attach to brackets 361, 362.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A water sprayer outlet mechanism configured for use with a pool, the water sprayer outlet mechanism having an inlet and an outlet nozzle in fluid communication with the inlet, the outlet nozzle comprising:

an elongate hole configured to deliver water from the inlet to the pool, a planar projection of the elongate hole having a lateral axis and a central axis of symmetry, the elongate hole defined by:

a first elongate section;

wherein the first elongate section is calculated with a formula:

$$Y=a_4x^4+a_2x^2+a_0$$

wherein:

x is a value on the lateral axis;

Y is a value on the central axis;

$a_0 \geq 1$;

$10^{-5} \geq a_4 \geq 10^{-12}$; and $10^{-2} \geq a_2 \geq 10^{-6}$;

a second elongate section;

a first end section that connects the first and second elongate sections; and a second end section that connects the first and second elongate sections;

wherein a width of the elongate hole measured between the first and second elongate sections increases from the central axis to each of the first and second end sections.

2. The water sprayer outlet mechanism of claim 1, wherein $a_0=1.5$.

3. The water sprayer outlet mechanism of claim 1, wherein:

$10^{-7} \geq a_4 \geq 7*10^{-10}$; and $1.4*10^{-3} \geq a_2 \geq 3*10^{-4}$.

4. The water sprayer outlet mechanism of claim 1, wherein:

$a_4=9*10^{-10}$; and $a_2=5*10^{-4}$.

5. The water sprayer outlet mechanism of claim 1, wherein:

the first elongate section is curved; and the second elongate section is linear.

6. The water sprayer outlet mechanism of claim 1, wherein the elongate hole is symmetrical about the lateral axis.

7. The water sprayer outlet mechanism of claim 1, wherein the first and second elongate sections are curved.

8. The water sprayer outlet mechanism of claim 1, wherein the elongate hole is disposed on an arcuate surface of the outlet nozzle, such that the first and second elongate sections extend vertically downward from the central axis to each of the first and second end sections.

9. The water sprayer outlet mechanism of claim 1, wherein the outlet nozzle narrows from the inlet toward the elongate hole.

10. The water sprayer outlet mechanism of claim 1, further comprising:

a power generating mechanism in fluid communication with the inlet and the outlet nozzle; and a light source powered by the power generating mechanism and configured to illuminate the water.

11. The water sprayer outlet mechanism of claim 10, wherein the power generating mechanism comprises:

a cover having a plurality of deflecting plates; and an impeller having a plurality of blades arranged substantially perpendicular to the plurality of deflecting plates.

12. The water sprayer outlet mechanism of claim 11, wherein:

the power generating mechanism has a longitudinal axis;

the deflecting plates of the cover are inclined to the right relative to the longitudinal axis; and the blades of the impeller are inclined to the left relative to the longitudinal axis.

13. The water sprayer outlet mechanism of claim 11, wherein:

the power generating mechanism has a longitudinal axis;

the deflecting plates of the cover are inclined approximately 25-45 degrees relative to the longitudinal axis; and the blades of the impeller are inclined approximately 55-65 degrees relative to the longitudinal axis.

14. The water sprayer outlet mechanism of claim 10, wherein the power generating mechanism further comprises:

a stator;

a rotor coupled to the impeller and surrounding the stator; and a motor operably coupled to the stator.

15. The water sprayer outlet mechanism of claim 1, wherein the inlet is perpendicular to the outlet nozzle.

16. The water sprayer outlet mechanism of claim 1, wherein the inlet receives return water from the pool.

17. The water sprayer outlet mechanism of claim 1, wherein the outlet nozzle is pivotally coupled to the inlet via a ball joint.

18. The water sprayer outlet mechanism of claim 1, wherein the water sprayer outlet mechanism is one of L-shaped and T-shaped.

19. The water sprayer outlet mechanism of claim 1, further comprising a drain outlet in fluid communication with the inlet and the outlet nozzle.

20. The water sprayer outlet mechanism of claim 19, further comprising a check valve in fluid communication with the drain outlet, wherein the check valve is configured to close the drain outlet until a pressure in the water sprayer outlet mechanism exceeds a predetermined pressure on the check valve.

21. The water sprayer outlet mechanism of claim 1, wherein the outlet nozzle includes a wave-shaped water passageway.

22. The water sprayer outlet mechanism of claim 1, further comprising at least one bracket configured to couple the water sprayer outlet mechanism to a support structure of the pool.

23. A water sprayer outlet mechanism configured for use with a pool, the water sprayer outlet mechanism having an inlet and an outlet nozzle in fluid communication with the inlet, the outlet nozzle comprising:

an elongate hole configured to deliver water from the inlet to the pool, a planar projection of the elongate hole having a lateral axis and a central axis of symmetry, the elongate hole defined by:

a first elongate section;

a second elongate section;

wherein the first and second elongate sections are calculated with a formula:

$$Y=a_4x^4+a_2x^2+a_0$$

wherein:

x is a value on the lateral axis;

Y is a value on the central axis;

$a_0 \geq 1$;

$5*10^{-6} \geq a_4 \geq 5*10^{-13}$; and $5*10^{-3} \geq a_2 \geq 5*10^{-7}$;

a first end section that connects the first and second elongate sections; and a second end section that connects the first and second elongate sections;

wherein a width of the elongate hole measured between the first and second elongate sections increases from the central axis to each of the first and second end sections.

24. The water sprayer outlet mechanism of claim 23, wherein $a_0=1.5$.

25. The water sprayer outlet mechanism of claim 23, wherein $5*10^{-8} \geq a_4 \geq 3.5*10^{-10}$; and $7*10^{-4} \geq a_2 \geq 1.5*10^{-4}$.

26. The water sprayer outlet mechanism of claim 23, wherein $a_4=4.5*10^{-10}$; and $a_2=2.5*10^{-4}$.

27. A water sprayer outlet mechanism configured for use with a pool, the water sprayer outlet mechanism having an inlet and an outlet nozzle in fluid communication with the inlet, the outlet nozzle comprising:

an elongate hole configured to deliver water from the inlet to the pool, a planar projection of the elongate hole having a lateral axis and a central axis of symmetry, the elongate hole defined by:

a first elongate section;

a second elongate section;

a first end section that connects the first and second elongate sections; and a second end section that connects the first and second elongate sections;

wherein a width of the elongate hole measured between the first and second elongate sections increases from the central axis to each of the first and second end sections;

a power generating mechanism in fluid communication with the inlet and the outlet nozzle, the power generating mechanism comprising:

a cover having a plurality of deflecting plates; and an impeller having a plurality of blades arranged substantially perpendicular to the plurality of deflecting plates, wherein the blades of the impeller narrow from the inlet toward the outlet nozzle; and a light source powered by the power generating mechanism and configured to illuminate the water.

28. The water sprayer outlet mechanism of claim 27, wherein each blade of the impeller has a curved surface facing the cover.

29. The water sprayer outlet mechanism of claim 27, wherein the cover of the power generating mechanism further comprises a conical diversion body arranged to direct water toward the deflecting plates of the cover.

30. A water sprayer outlet mechanism configured for use with a pool, the water sprayer outlet mechanism having an inlet and an outlet nozzle in fluid communication with the inlet, the outlet nozzle comprising:

an elongate hole configured to deliver water from the inlet to the pool, a planar projection of the elongate hole having a lateral axis and a central axis of symmetry, the elongate hole defined by:

a first elongate section;

a second elongate section;

a first end section that connects the first and second elongate sections;

a second end section that connects the first and second elongate sections;

wherein a width of the elongate hole measured between the first and second elongate sections increases from the central axis to each of the first and second end sections;

a drain outlet in fluid communication with the inlet and the outlet nozzle;

a check valve in fluid communication with the drain outlet, wherein the check valve is configured to close the drain outlet until a pressure in the water sprayer outlet mechanism exceeds a predetermined pressure on the check valve; and a knob configured to adjust the predetermined pressure on the check valve.

* * * * *